US010910133B2

(12) United States Patent
Suenaga et al.

(10) Patent No.: US 10,910,133 B2
(45) Date of Patent: Feb. 2, 2021

(54) LINEAR SHAPE MEMBER AND PRODUCING METHOD THEREFOR

(71) Applicant: Hitachi Metals, Ltd., Tokyo (JP)

(72) Inventors: Kazufumi Suenaga, Tokyo (JP); Hideyuki Sagawa, Tokyo (JP); Takahiro Sugiyama, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/738,731

(22) Filed: Jan. 9, 2020

(65) Prior Publication Data

US 2020/0243226 A1 Jul. 30, 2020

(30) Foreign Application Priority Data

Jan. 24, 2019 (JP) ..... 2019-009935

(51) Int. Cl.

| | |
|---|---|
| ***H01B 13/14*** | (2006.01) |
| ***H01B 11/00*** | (2006.01) |
| ***H01B 13/22*** | (2006.01) |
| ***C23C 18/18*** | (2006.01) |
| ***C25D 5/34*** | (2006.01) |
| ***C23C 28/02*** | (2006.01) |
| *H01B 3/42* | (2006.01) |

(52) U.S. Cl.

CPC ..... *H01B 13/145* (2013.01); *C23C 18/1806* (2013.01); *C23C 28/02* (2013.01); *C25D 5/34* (2013.01); *H01B 11/00* (2013.01); *H01B 13/222* (2013.01); *H01B 3/427* (2013.01); *H01B 13/148* (2013.01)

(58) Field of Classification Search

CPC combination set(s) only.
See application file for complete search history.

(56) References Cited

U.S. PATENT DOCUMENTS 2,173,565 A * 9/1939 Peterson ..... H01P 3/04 174/117 R
2,782,251 A * 2/1957 Ebel ..... H01P 3/04 174/113 AS
3,229,024 A * 1/1966 Kang ..... H01B 9/0611 174/25 R
3,373,244 A * 3/1968 Holland ..... H01B 13/225 174/102 R
3,419,669 A * 12/1968 Dienes ..... H02G 15/18 174/84 R
5,128,175 A * 7/1992 Yamanishi ..... H01B 7/0233 427/515
5,177,996 A * 1/1993 Sahakian ..... G01M 3/165 324/533

(Continued)

FOREIGN PATENT DOCUMENTS

JP 2005149892 A * 6/2005
JP 6245402 B1 12/2017

*Primary Examiner* — Binh B Tran
*Assistant Examiner* — Krystal Robinson
(74) *Attorney, Agent, or Firm* — McGinn I.P. Law Grouts, PLLC.

(57) ABSTRACT

A linear shape member is composed of a linear shape electrical insulating body comprising irregularities on a surface, and a plating layer coating the surface of the electrical insulating body. An average irregularities spacing Sm of the irregularities is not more than 20.0 μm.

20 Claims, 13 Drawing Sheets

(56) References Cited

U.S. PATENT DOCUMENTS

| | | | | |
|---|---|---|---|---|
| 5,192,834 | A * | 3/1993 | Yamanishi | H01B 7/0233 174/110 F |
| 6,040,106 | A * | 3/2000 | Hori | G03G 5/00 430/127 |
| 2005/0117845 | A1* | 6/2005 | Hirose | G02B 6/138 385/39 |
| 2005/0238859 | A1* | 10/2005 | Uchimaru | C04B 35/62655 428/209 |
| 2010/0142998 | A1* | 6/2010 | Furukawa | G03G 15/0233 399/176 |
| 2014/0335310 | A1* | 11/2014 | Matsumoto | B29C 48/503 428/141 |
| 2018/0011157 | A1* | 1/2018 | Schoen | G01R 33/3856 |
| 2019/0013559 | A1 | 1/2019 | Suenaga et al. | |

* cited by examiner

LINEAR SHAPE MEMBER AND PRODUCING METHOD THEREFOR

CROSS-REFERENCE TO RELATED APPLICATIONS

The present invention is based on Japanese Patent Application No. 2019-009935 filed on Jan. 24, 2019, the entire contents of which are incorporated herein by reference.

BACKGROUND OF THE INVENTION

1. Field of the Invention

The present invention relates to a linear shape member and a producing method therefor.

2. Description of the Related Art

Conventionally, there is known a method for producing a differential signal transmission cable provided with one pair of signal wires, an electrical insulating body layer, which is coating a periphery of the one pair of signal wires, and a plating layer, which serves as a shield to coat the electrical insulating body layer. This differential signal transmission cable producing method is designed to perform a surface roughening treatment, such as a dry ice blasting treatment or the like, on an outer peripheral surface of the electrical insulating body layer, thereafter perform a surface modification treatment such as a corona discharge exposure treatment or the like, on the outer peripheral surface of the electrical insulating body layer, and thereafter form a plating layer on the outer peripheral surface of the electrical insulating body layer (see Japanese Patent No. 6245402).

According to Japanese Patent No. 6245402, the surface roughening treatment allows the outer peripheral surface of the electrical insulating body layer to be not lower than 0.6 μm in arithmetic mean roughness Ra, thereby making it possible to enhance the strength of the adhesion between the plating layer and the electrical insulating body layer, and suppress the occurrence of a separation of the plating layer from the electrical insulating body layer or the occurrence of an air gap formation between the plating layer and the electrical insulating body layer.

In addition, according to Japanese Patent No. 6245402, the surface modification treatment allows the degree of crystallization required by X-ray diffraction measurement to fall within a predetermined range, thereby making it possible to facilitate the homogenization of the thickness of the plating layer, and suppress the transmission loss in the differential signal transmission cable.

[Patent Document 1] Japanese Patent No. 6245402

SUMMARY OF THE INVENTION

The peeling of the plating layer overlying the electrical insulating body from the electrical insulating body or the formation of an air gap between the plating layer and the electrical insulating body leads to a degradation in the transmission properties of the cable. For example, if the plating layer, which serves as the shield, is peeled from the electrical insulating body in the cable, its shield function is degraded, therefore leading to a degradation in the transmission properties of the cable. Also, if an air gap is formed between the plating layer and the electrical insulating body, since the air is lower in dielectric constant than the electrical insulating body, the dielectric constant in the vicinity of the interface between the plating layer and the electrical insulating body becomes non-uniform, which also leads to a degradation in the transmission properties of the cable.

For this reason, in order to suppress the degradation of the transmission properties of the cable, it is important to make high the strength of the adhesion between the electrical insulating body and the plating layer provided over the surface of that electrical insulating body. In order to enhance the strength of the adhesion between the plating layer and the electrical insulating body more effectively and more efficiently than in the conventional technique, it is necessary to find out a parameter more closely related to the strength of the adhesion between the plating layer and the electrical insulating body, and control it.

Accordingly, one object of the present invention is to provide a linear shape member, which is higher in the strength of the adhesion between an electrical insulating body and a plating layer overlying a surface of that electrical insulating body than the conventional one, and which is designed to suppress the occurrence of a peeling of the overlying plating layer from the underlying electrical insulating body, or the occurrence of an air gap formation between the overlying plating layer and the underlying electrical insulating body, and another object of the present invention is to provide a method for producing the same linear shape member.

For the purpose of solving the above problems, the present invention provides a linear shape member, comprising: a linear shape electrical insulating body comprising irregularities on a surface; and a plating layer coating the surface of the electrical insulating body, wherein an average irregularities spacing Sm of the irregularities is not more than 20.0 μm.

Points of the Invention

According to the present invention, it is possible to provide the linear shape member which is higher in the strength of the adhesion between the electrical insulating body and the plating layer overlying the surface of that electrical insulating body than the conventional one, and which is designed to suppress the occurrence of a peeling of the overlying plating layer from the underlying electrical insulating body, or the occurrence of an air gap formation between the overlying plating layer and the underlying electrical insulating body, and it is possible to provide the method for producing the same linear shape member.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Embodiments (Structure of a Linear Shape Member)

Figure 1:
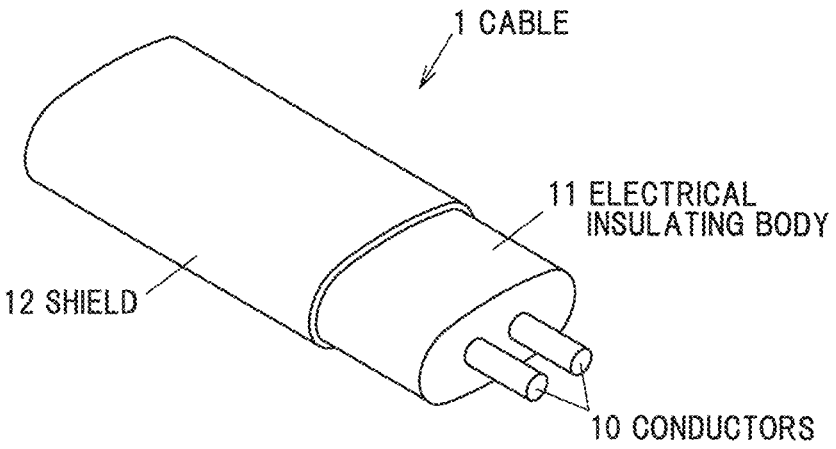
FIG. 1 is a perspective view showing a cable according to an embodiment.

FIG. 1 is a perspective view showing a cable 1 to be used as a linear shape member according to an embodiment. The cable 1 is being configured to include two conductors 10, a linear shape electrical insulating body 11, which is being provided over a periphery of the two conductors 10, and a shield 12, which is being provided in such a manner as to directly coat a surface (an outer peripheral surface) of the electrical insulating body 11. The cable 1 is, e.g., 500 to 1500 μm in diameter.

The linear shape conductors 10 constitute a core of the cable 1 and are each made of a conductor such as a copper or the like. Further, the conductors 10 may be configured as a stranded wire, which is formed by laying a plurality of conducting wires together in order to ensure a bending property. The number of the conductors 10 included in the cable 1 is not particularly limited, but is appropriately determined according to a type of the cable 1. In the example shown in FIG. 1, the cable 1 is a differential signaling cable including a twinaxial structure, and is being configured to include the two conductors 10.

The electrical insulating body 11 is made of an insulating material including a small dielectric constant or a dielectric loss tangent (tan δ), such as a polyethylene or a fluoropolymer resin or the like. The electrical insulating body 11 may be provided over the conductors 10 with the other member not shown therebetween. In other words, the electrical insulating body 11 is provided in such a manner as to directly or indirectly coat the conductors 10.

The shield 12 is a plating layer, which is formed by performing a plating treatment on the surface of the electrical insulating body 11. The shield 12 is made of a metal such as a copper or the like. The shield 12 is, e.g., 1 to 10 μm in thickness.

Since the shield 12 is the plating layer, an air gap formation is less likely to occur between the overlying shield 12 and the underlying electrical insulating body 11 as compared to a conventionally generally used shield made of a metal tape wrapped around a periphery of an electrical insulating body, and so the shield 12 is able to suppress the occurrence of a degradation in the transmission properties of the cable 1 due to this air gap formation. In particular, when the cable 1 is a thin diameter cable such as a high speed transmission cable or the like, using the plating layer as the shield 12 has a profound effect because when the metal tape is used as the shield 12, the metal tape is difficult to wrap around the periphery of the electrical insulating body 11 of the cable 1 and is more likely to cause the air gap formation between the overlying shield 12 and the underlying electrical insulating body 11.

Further, since the shield 12 is the plating layer, the shield 12 is not required to be of such a thickness that a mechanical strength required for the wrapping, as in the case of the shield made of the metal tape, is produced, but the shield 12 may be of such a thickness as to be able to suppress noise in the cable 1. For example, when a noise reduction of 1/30 to 1/1000 required for shielding for a general electronic device is assumed (see, e.g., "Technical Description, Electromagnetic shield", Okayama Industrial Technology Center, Technical Information, No. 457, p. 5), on the principle of the skin effect, even when the copper shield is thinned to 1 to 2 μm, a substantially desired shielding effect can be obtained in a band of several tens of GHz. This allows the thickness of the shield 12 made of the plating layer to be reduced to about 1/10 of the thickness of the shield made of the metal tape. Note that the plating treatment for the present embodiment to be described later makes it possible to form the shield 12 including a uniform thickness of several tens of nm to several tens of μm.

For the cable 1 to be formed with the shield 12 on the surface of the electrical insulating body 11 by the plating treatment, the electrical insulating body 11 to serve as an underlying plating base is being subjected to a surface treatment under proper conditions, so as to impart the sufficient strength of the adhesion between the underlying electrical insulating body 11 and the overlying shield 12. Here, the surface treatment refers to a roughening treatment or a modification treatment, and preferably includes both of them. Details of the surface treatment will be described later.

(Features of the Electrical Insulating Body)

The material for the electrical insulating body 11, if it is a material which is not dissolvable by contact with a catalyst solution or a plating solution to be used in order to form the shield 12, is not particularly limited, but, typically, the material for the electrical insulating body 11 is a polyethylene or a fluoropolymer resin. In particular, the polyethylene is preferable as the material for the electrical insulating body 11 because it is easy in availability and high in performance of electron beam resistance. Specific examples of the fluoropolymer resin to be able to be used include a polytetrafluoroethylene (PTFE), a perfluoroalkoxy (PFA), a perfluoroethylene propene copolymer (PEP), an ethylene-tetrafluoroethylene copolymer (ETFE), a tetrafluoroethylene-perfluorodioxole copolymer (TFE/PDD), a polyvinylidene fluoride (PVDF), a polychlorotrifluoroethylene (PCTFE), an ethylene-chlorotrifluoroethylene copolymer (ECTFE), a polyvinyl fluoride (PVF), and the like.

Further, in order to reduce the dielectric constant and the dielectric loss tangent, a foamed electrical insulating resin may be used as the material for the electrical insulating body 11. In this case, the electrical insulating body 11 can be formed by using, e.g., a method, which kneads a foaming agent into a resin, and controls the degree of formation of foam in that fluoropolymer resin by using the temperature or pressure during molding, a method, which injects an inert gas such as nitrogen or the like into a fluoropolymer resin at a molding pressure, and allows formation of foam in that fluoropolymer resin during pressure release, or the like.

In a transverse cross section of the cable 1, it is preferable that an outer edge of the electrical insulating body 11 is being formed in a circular shape, an elliptical shape, or a rounded corner rectangular shape (a rectangular shape with rounded corners). In this case, the plating layer is easy to form with a uniform thickness on the entire surface of the electrical insulating body 11. Further, the roughening treatment and the modification treatment, which will be described later, are easy to perform uniformly on the entire surface of the electrical insulating body 11.

It is preferable that the electrical insulating body 11 has irregularities, i.e. projections and neighboring depressions, formed by the later described roughening treatment, in a surface roughness profile of a surface of that electrical insulating body 11. And, it is preferable that this electrical insulating body 11 has an average irregularities spacing Sm (of the irregularities), which is an arithmetic mean value of spacings between the projections and the neighboring depressions in the surface roughness profile, of not more than 20.0 μm. Further, it is preferable that this electrical insulating body 11 has a mean spacing of local peaks S (of the irregularities), which is a mean value of spacings between adjacent local asperity peaks of the projections and the neighboring depressions in the surface roughness profile, of not more than 3.0 μm.

Here, the average irregularities spacing Sm is a parameter of the surface roughness defined in JIS B 0601-1994, and refers to the one obtained by sampling a part of a surface roughness profile curve by a reference length in a direction of a mean line (also called a center line) of that roughness profile, and in the sampled part of the roughness profile, calculating a sum of lengths of mean line elements of the mean line, each mean line element being in correspondence with one asperity and one valley adjacent to that asperity, of the roughness profile, and an arithmetic mean value expressed in mm of the spacings (i.e., the lengths of the mean line elements) between those multiple projections (asperities) and neighboring depressions (valleys) in the surface roughness profile. Further, the mean spacing of local peaks S is a parameter of the surface roughness defined in JIS B 0601-1994, and refers to the one obtained by sampling a part of a surface roughness profile curve by a reference length in a direction of a mean line (also called a center line) of that roughness profile, and in the sampled part of the roughness profile, calculating lengths of mean line elements of the mean line, each mean line element being in correspondence with one spacing between adjacent local asperity peaks, and an arithmetic mean value expressed in mm of the spacings (i.e., the lengths of the mean line elements) between those multiple adjacent local asperity (projection) peaks.

When the surface of the electrical insulating body 11 is being configured to meet the above surface roughness conditions, a catalyst, which is used in the plating treatment for forming the shield 12, becomes resistant to desorption from the surface of the electrical insulating body 11. In addition, there is an enhancement in an anchoring effect, which is produced by the shield 12 passing into the depressed portions of the irregularities on the surface of the electrical insulating body 11. This results in an enhancement in the strength of the adhesion between the overlying shield 12 made of the plating layer and the underlying electrical insulating body 11. Furthermore, since there is an increase in the surface area of the electrical insulating body 11, there is an increase in the amounts of polar functional groups to be produced that contribute to an enhancement in the surface wettability resulting from the modification treatment, which will be described later.

In the surface roughness profile of the surface of the electrical insulating body 11, the lower limit values for the average irregularities spacing Sm or the mean spacing of local peaks S are not particularly limited, but may be such sizes as to be able to be produced. That is, in the surface roughness profile of the surface of the electrical insulating body 11, the lower limit values for the average irregularities spacing Sm or the mean spacing of local peaks S depend on a method for the roughening treatment.

As the roughening treatment 11, it is possible to use a blasting treatment, for example Examples of the blasting treatment to be able to be used include: a dry ice blasting using dry ice particles as a blasting medium; a sand blasting using particles of alumina, SiC or the like as the blasting medium; a wet blasting using a liquid mixture (slurry) of water and an abrasive material as the blasting medium; and the like. Note that, in a case where the electrical insulating body 11 is made of a soft material such as a fluoropolymer resin or the like, a low temperature blasting treatment that is performed in such a manner that an object (the electrical insulating body 11) to be subjected to the blasting treatment remains lowered in temperature under a low temperature condition is effective in the roughening treatment 11.

In particular, the dry ice blasting is preferably used in the roughening treatment 11. Since the dry ice sublimes under ambient pressure and does not remain on the surface of the electrical insulating body 11 after the roughening treatment, when the dry ice blasting is used as the roughening treatment 11, there is no need for a cleaning step after the roughening treatment.

When the blasting treatment is used in the roughening treatment 11, by adjusting the particle diameter of the blasting medium to be used in the blasting treatment, the blasting pressure (spraying pressure) to be used in the blasting treatment, the distance between the blasting nozzle of the blasting device and the electrical insulating body 11, the hardness of the electrical insulating body 11, or the like, the average irregularities spacing Sm of the irregularities of the surface of the electrical insulating body 11 can be controlled and reduced to not more than 70 μm. Further, the mean spacing of local peaks S of the irregularities can be controlled and reduced to not more than 3.0 μm.

Alternatively, a laser irradiation treatment may be used in the roughening treatment 11. In this case, by adjusting the spot diameter of the laser or the like, the average irregularities spacing Sm of the irregularities of the surface of the electrical insulating body 11 can be controlled and reduced to not more than 20.0 μm. Further, in a case where the electrical insulating body 11 is made of a material, which is low in resistance to the electron beam irradiation, such as a fluoropolymer resin or the like, the electron beam irradiation may be used as the roughening treatment 11. In this case, by adjusting the irradiation electric current density of the electron beam or the like, the average irregularities spacing Sm of the irregularities of the surface of the electrical insulating body 11 can be controlled and reduced to not more than 20.0 μm. Further, the mean spacing of local peaks S of the irregularities can be controlled and reduced to not more than 3.0 μm.

Alternatively, in a case where the average irregularities spacing Sm of the spacings between the projections and the neighboring depressions or the mean spacing of local peaks S of the irregularities of the surface of the electrical insulating body 11 can be controlled by adjusting the reaction rate between a chemical solution and the electrical insulating body 11 with the concentration or temperature of the chemical solution, a wet etching treatment using the chemical solution such as a sodium naphthalene complex solution or a chromic acid solution may be used in the roughening treatment 11. It should be noted, however, that, when the electrical insulating body 11 is made of the polyethylene or the fluoropolymer resin, the use of the wet etching treatment using the chromic acid solution is not practical because the wet etching treatment using the chromic acid solution is very time-consuming.

Alternatively, the surface of the electrical insulating body 11 may be subjected to the roughening treatment by performing a short period pulsation during extrusion molding of the electrical insulating body 11. Alternatively, the surface of the electrical insulating body 11 may be subjected to the roughening treatment during extrusion molding of the electrical insulating body 11 by providing projections and depressions for roughening the surface of the electrical insulating body 11 on an inner wall of a die of an extruder.

The average irregularities spacing Sm or the mean spacing of local peaks S of the irregularities of the surface of the electrical insulating body 11 can be measured with a laser microscope, a scanning probe microscope, or the like.

In addition, it is preferable that the electrical insulating body 11 is being made high in degree of crystallization, Xc, by a modification treatment. By the electrical insulating body 11 being made high in the degree of crystallization Xc, the electrical insulating body 11 is increased in density while being decreased in the dielectric loss tangent (tan δ). This results in a decrease in dielectric loss in the electrical insulating body 11.

By comparison of a peak intensity of a crystalline component and a peak intensity of an amorphous component in a Fourier transform infrared absorption spectrum, the proportion of the crystalline substance in the electrical insulating body 11 can be estimated and quantified as the degree of crystallization, Xc. That is, a change in the degree of crystallization, Xc, resulting from the modification treatment can be analyzed in detail (see, e.g., "Polymer Infrared/Raman Spectroscopy", written and edited by Toshikatsu Nishioka (Kodansha, Ltd., 2015)).

Here, the degree of crystallization, Xc, of the polyethylene is expressed by equation 1 below (see, e.g., Nicole M. Stark, and Laurent M. Matuana "Surface chemistry changes of weathered HDPE/wood-flour composites studied by XPS and FT-IR spectroscopy" Polymer Degradation and stability 86 (2004) pp. 1-9).

$$X_c = 1 - \frac{\left(1 - \frac{I_c}{I_a}\right)/1.233}{\left(1 + \frac{I_c}{I_a}\right)} \quad \text{[Equation 1]}$$

The Ic in the equation 1 is the intensity of the absorption peak (wave number about 730 $cm^{-1}$) of the crystalline component in the Fourier transform infrared absorption spectrum in the electrical insulating body 11. Also, the Ia in the equation 1 is the intensity of the absorption peak (wave number about 720 $cm^{-1}$) of the amorphous component in the Fourier transform infrared absorption spectrum in the electrical insulating body 11.

The Ic and the Ia in the equation 1 are obtained from the Fourier transform infrared absorption spectrum by an integral intensity calculation. Specifically, in practice, the Ic and the Ia in the equation 1 are derived by a spectrum fitting analysis using a distribution function such as a Gauss function or a Lorentz function, or as convolution functions of the Gauss function and the Lorentz function, a Pseudo Voight function, a Pearson function, a Split Pseudo Voight function, or the like.

In measurement using a total internal reflection absorption measurement method (ATR: Attenuated Total Reflection) (hereinafter referred to as the ATR measurement), which is one of Fourier transform infrared absorption spectroscopy methods, a depth dp to which incident infrared light penetrates into the electrical insulating body 11 is defined as a depth at which the intensity of the incident infrared light (the intensity of the above-described Ic or Ia) falls to 1/e (the reciprocal of Napier's constant), and is expressed by equation 2 below (see, e.g., FT-IR Basics and Practice 2nd edition, written and edited by Mitsuo Tasumi, (Tokyo Kagaku Doujin, 1994).

$$d_p = \frac{\lambda_1}{2\pi\sqrt{\sin^2\theta - n_{21}^2}} \quad \text{[Equation 2]}$$

The θ in the equation 2 is the angle of incidence of the infrared light on the sample. Also, the $n_{21}$ in the equation 2 is the value of the ratio between the refractive index of a sample and the refractive index of an ATR crystal. The $\lambda_1$ is the wavelength in the ATR crystal.

According to the equation 2, when a Ge crystal having a refractive index of 4.0 is used as the ATR crystal and the incident angle θ of the infrared light is 45 degrees, the penetration depth dp of the infrared light into the electrical insulating body 11 made of the polyethylene is about 0.92 to 0.93 μm in a wave number range of 720 to 730 $cm^{-1}$. That is, by measuring the Fourier transform infrared absorption spectrum, it is possible to know the degree of crystallization, Xc, within the region of the depth of up to about 1 μm from the surface of the electrical insulating body 11. Hereinafter, the degree of crystallization, Xc, of the electrical insulating body 11 in the embodiments and examples of the present invention, even when not particularly specified, means the degree of crystallization, Xc, within the region of the depth of up to about 1 μm from the surface of the electrical insulating body 11.

Note that, although, as described in Japanese Patent No. 6245402 described above, there is a method of investigating the degree of crystallization by X-ray diffraction measurement, the Fourier transform infrared absorption spectrum measurement is designed to investigate the degree of crystallization in a very shallow region of the electrical insulating body 11 which is the region of the depth of up to about 1 μm from the surface of the electrical insulating body 11, whereas the X-ray diffraction measurement is designed to investigate the degree of crystallization in a very wide region of the electrical insulating body 11. This is because the penetration depth of X-rays is much greater than the penetration depth of the infrared light. For example, the penetration depth of the X-rays into the polyethylene is about 3 mm, which is about 3000 times that of the infrared light. Since the region of the electrical insulating body 11 in which the degree of crystallization, Xc, of the electrical insulating body 11 is changed by the modification treatment is principally the shallow region adjacent to the surface of the electrical insulating body 11, it can be said that the Fourier transform infrared absorption spectrum measurement that is able to measure the degree of crystallization of that shallow region of the electrical insulating body 11 is suitable for the high precision investigation of the effect of the modification treatment on the electrical insulating body 11.

The electrical insulating body 11 made of the polyethylene is preferably not lower than 0.512 and not higher than 0.685 in the degree of crystallization, Xc, within the region of the depth of up to 1 μm from the surface thereof. When the electrical insulating body 11 made of the polyethylene is being configured to meet the above condition for the degree of crystallization Xc, the dielectric loss in the electrical insulating body 11 is effectively reduced, and therefore the transmission loss of the cable 1 is effectively reduced.

In addition, the surface modification treatment for the electrical insulating body 11 also has an effect of producing a polar functional group in the surface of the electrical insulating body 11 and thereby enhancing the wettability of the surface of the electrical insulating body 11. Here, the polar functional group refers to a functional group (a hydrophilic group) having a polarity such as a carbonyl group or a hydroxy group or the like. The polar functional group also includes, besides the functional group containing oxygen such as the carbonyl group or the hydroxy group, a functional group containing nitrogen or the like in place of oxygen. In general, the presence of the polar functional group is directly related to the surface wettability (see, e.g., Akira Nakajima, "The Wettability of Solid Surfaces, from Superhydrophilicity to Superhydrophobicity" (Kyoritsu Publishing Co., Ltd., 2014)).

By the wettability of the surface of the electrical insulating body 11 being enhanced, a catalyst solution or the plating solution to be used in the plating treatment for the surface of the electrical insulating body 11 is easily brought into contact with the surface of the electrical insulating body 11 over the entire circumference thereof. As a result, the strength of the adhesion between the overlying shield 12 made of the plating layer and the underlying electrical insulating body 11 is enhanced, and the uniformity of the thickness of the shield 12 is also enhanced. By the strength of the adhesion between the overlying shield 12 and the underlying electrical insulating body 11 being enhanced, it is possible to suppress the occurrence of a degradation in the transmission properties of the cable 1 due to the formation of an air gap between the overlying shield 12 and the underlying electrical insulating body 11. Further, by the uniformity of the thickness of the shield 12 being enhanced, it is possible to suppress the occurrence of a degradation in the transmission properties of the cable 1, which is caused by a variation in the thickness of the shield 12. In addition, by performing both the roughening treatment and the modification treatment, a plating solution, which is used in the plating treatment for forming the shield 12, is easy to pass into the depressed portions of the surface irregularities of the electrical insulating body 11 formed by the roughening treatment, and is therefore easier to spread over the surface of the electrical insulating body 11.

The degree of crystallization, Xc, within the region of the depth of up to 1 μm from the surface of the electrical insulating body 11 being not lower than 0.512 and not higher than 0.685, shows that the amount of the carbonyl group to be able to impart the wettability suitable for the plating treatment is being produced in the surface of the electrical insulating body 11 by the modification treatment before the formation of the shield 12.

For the modification treatment for the surface of the electrical insulating body 11, it is possible to use, for instance, a corona discharge exposure, a plasma exposure in a gas with an atmospheric composition gas or a rare gas mixed therein, an ultraviolet irradiation, an electron beam irradiation, a y-ray irradiation, an X-ray irradiation, an ion beam irradiation, an immersion in an ozone containing liquid, or the like.

For example, when the corona discharge exposure using a device of a type that corona discharge light is radiated from a discharge probe is used in the modification treatment for the surface of the electrical insulating body 11, by adjusting the voltage output, the distance between the surface of the electrical insulating body 11 and the tip of the discharge probe, the number of scans with the discharge probe, the exposure time, or the like, the degree of crystallization, Xc, within the region of the depth of up to 1 μm from the surface of the electrical insulating body 11 can be controlled and set at not lower than 0.512 and not higher than 0.685.

(Cable Producing Method)

Hereinafter, one example of a method for producing the cable 1 according to the present embodiment will be described.

Figure 2:
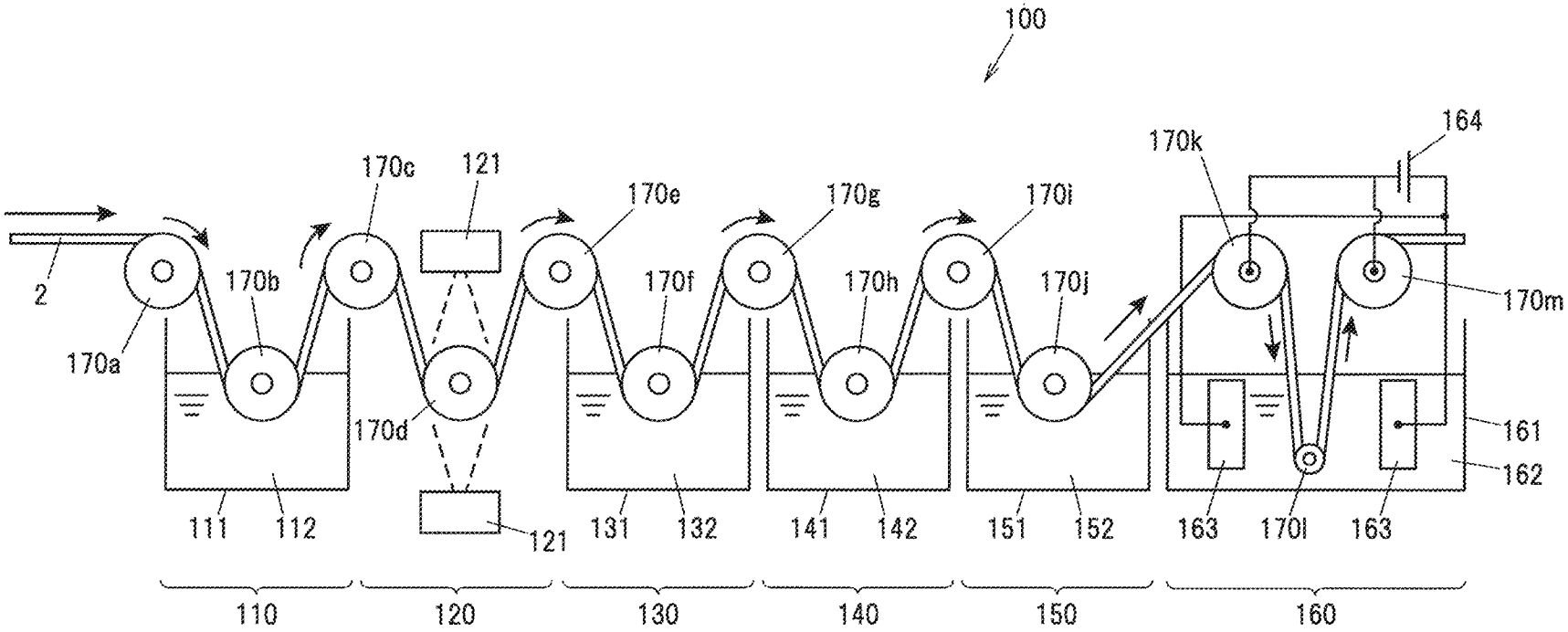
FIG. 2 is a schematic diagram showing a configuration of a shield forming system used in forming a shield which is made of a plating layer for the cable.

FIG. 2 is a schematic diagram showing a configuration of a shield forming system 100 used in forming the shield 12 that is made of the plating layer for the cable 1. The shield formation system 100 is being configured to include a degreasing unit 110, a surface treatment unit 120, a first activation unit 130, a second activation unit 140, an electroless plating unit 150, an electrolytic plating unit 160, and bobbins 170*a* to 170*m* for transferring a cable 2.

In the shield forming system 100, by continuously operating the bobbins 170*a* to 170*m* at a desired rotational speed, the cable 2 is transferred at a desired speed while being maintained at a constant tension. The cable 2 before being passed through the shield forming system 100 is the cable composed of the two conductors 10 and the electrical insulating body 11 provided over the periphery of the two conductors 10, and is passed through the shield forming system 100 where the cable 2 is formed with the shield 12, thereby resulting in the cable 1. Note that the electrical insulating body 11 can be provided by, e.g., known extrusion molding.

The degreasing unit 110 is being designed to remove grease on the surface of the electrical insulating body 11, and is being configured to include a degreasing bath 111 and a degreasing liquid 112 held by that degreasing bath 111. The degreasing liquid 112 is being configured to include, e.g., a sodium borate, a sodium phosphate, a surface active agent, and the like. In order for the cable 2 to be transferred to and passed through the degreasing liquid 112, at least a part of the bobbin 170*b* is being located in the degreasing liquid 112.

The surface treatment unit 120 is being designed to perform a surface treatment on the electrical insulating body 11 and is being configured to include a surface treatment device 121. Examples of the surface treatment device 121 to be used include, for performing the aforementioned roughening treatment, a blasting device, a laser device, an etching device using a chromic acid, a sulfuric acid or the like as an etchant, and the like, and, for performing the aforementioned modification treatment, a corona treatment device, a plasma treatment device, an ultraviolet irradiation device, an electron beam irradiation device, a y-ray irradiation device, an X-ray irradiation device, an ion beam irradiation device, an etching device using an ozone containing liquid or the like as an etchant, and the like.

When both the roughening treatment and the modification treatment are performed as the surface treatment for the electrical insulating body 11, or when a plurality of the roughening treatments or a plurality of the modification treatments are performed as the surface treatment for the electrical insulating body 11, a plurality of types of the surface treatment devices 121 mentioned above may be included in the surface treatment unit 120. The first activation unit 130 is being designed to form a catalytically active layer on the surface of the electrical insulating body 11, and is being configured to include a first activation bath 131, and a first activation liquid 132 held by that first activation bath 131. The first activation liquid 132 is being configured to include, e.g., a palladium chloride, a stannous chloride, a concentrated hydrochloric acid, and the like. The catalytically active layer is being designed to form the dense high-quality plating layer as the shield 12. In order for the cable 2 to be transferred to and passed through the first activation liquid 132, at least a part of the bobbin **170*f* is being located in the first activation liquid 132**.

The second activation unit 140 is being designed to clean the surface of the catalytically active layer formed by the first activation unit 130, and is being configured to include a second activation bath 141, and a second activation liquid 142 held by that second activation bath 141. The second activation liquid 142 is, e.g., a sulfuric acid. In order for the cable 2 to be transferred to and passed through the second activation liquid 142, at least a part of the bobbin **170*h* is being located in the second activation liquid 142**.

The electroless plating unit 150 is being designed to form an electroless plating layer before an electrolytic plating treatment, and make the surface of the electrical insulating body 11 (the surface of the catalytically active layer) electrically conductive, and is being configured to include an electroless plating bath 151, and an electroless plating solution 152 held by that electroless plating bath 151. The electroless plating solution 152 is being configured to include, e.g., a copper sulfate, a Rochelle salt, a formaldehyde, a sodium hydroxide and the like. In order for the cable 2 to be transferred to and passed through the electroless plating solution 152, at least a part of the bobbin **170*j* is being located in the electroless plating solution 152**.

The electrolytic plating unit 160 is being designed to perform an electrolytic plating treatment, and is being configured to include an electrolytic plating bath 161, an electrolytic plating solution 162 held by that electrolytic plating bath 161, one pair of anodes 163, and a power supply unit 164.

As examples of compositions of the electrolytic plating solutions 162, a composition of a copper sulfate ($CuSO_4$) plating solution and a composition of a copper cyanide (CuCN) plating solution, and producing methods therefor are shown below.

[Copper Sulfate Plating Solution]

An example of the composition of the copper sulfate plating solution for the electrolytic plating solution 162 is shown in Table 1. The plating solution composition components, "sodium chloride, hydrochloric acid" shown in Table 1 are examples of chlorides.

TABLE 1

| Plating solution composition | Chemical formula | Concentration (g/l) |
|---|---|---|
| Copper sulfate | $CuSO_4 \cdot 5H_2O$ | 60-250 |
| Copper metal | Cu | 15-70 |
| Sulfuric acid | $H_2SO_4$ | 25-220 |
| Chlorine ion (sodium chloride, hydrochloric acid) | $Cl^-$ (NaCl, HCl) | 0.02-0.2 |

First, about 60 to 70% water by volume of the entire plating solution is put into the sufficiently cleaned electrolytic plating bath 161, and thereafter the water temperature thereof is elevated from room temperature to around 50 degrees C. Next, an amount of a copper sulfate corresponding to a required plating deposition amount depending on the desired thickness of the shield 12, the size or length of the cable 2, and the like is put into the above-mentioned heated water, which is agitated until the completion of the dissolution of that copper sulfate. Then, in order to control the electrical conductivity (electric current density) of the plating solution and the solubility of the anode copper plate to their respective proper ranges, a required amount of a sulfuric acid is added to the plating solution while being agitated, and thereafter, water is additionally put into the plating solution until the amount of the plating solution reaches the finally required plating solution amount. Further, in order to remove impurities in the plating solution, an activated carbon is put into the plating solution or an activated carbon layer is provided on a filtering medium of a filtering machine, and thereafter the plating solution is circulated through the filtering machine and the activated carbon with the impurities adsorbed thereon is removed.

Next, in order to match the concentration of chlorine ions, which enhance the action of a surface gloss of the plating layer, to a predetermined value, a sodium chloride or a hydrochloric acid or the like is appropriately added to the plating solution. Then, it is analyzed and checked whether the sulfuric acid and the copper sulfate are at their respective specified concentrations. Next, after properly adding an additive agent such as a gloss agent or a surface active agent or the like being compatible to the material for the electrical insulating body 11, the Hull cell test (see, e.g., Shikio Yamana "Mechanical Engineering Introductory Series, Introduction to Plating Work", Rikogakusha Publishing Co., Ltd. or Hidehiko Enomoto, Naoji Furukawa, Soujun Matsumura, "Composite Plating", Nikkan Kogyo Shimbun, Ltd.) is performed to check a state of the plating solution as to whether the desired plating layer can be produed or not. Finally, after performing an electrolytic purification at on the order of 10 $A/dm^2$ or so for several hours while performing a continuous filtration, it is checked whether or not the plating film can stably be formed.

When the copper sulfate plating solution is used as the electrolytic plating solution 162 to form a Cu atom (metal) from a Cu ion, a reaction represented by chemical equation 3 below occurs. Chemical equation 3 represents that a divalent Cu cation gains two electrons to become a Cu atom (metal).

$$Cu^{2+}+2e^- \rightarrow Cu \qquad \text{[Equation 3]}$$

In the reaction represented by chemical equation 3, since two electrons become necessary for one Cu ion, the amount of electric charges necessary to produce 1 mol of Cu is about 192,971 C which is two times the product of the elementary electric charge and the Avogadro constant. For this reason, in light of the atomic mass of copper being 63.54, the amount of electric charges necessary to form 1 g of copper is about 3,037 C/g.

[Copper Cyanide Plating Solution]

An example of the composition of the copper cyanide plating solution for the electrolytic plating solution 162 is shown in Table 2. The plating solution composition components, "free sodium cyanide (free potassium cyanide)" shown in Table 2 are alkali cyanides remaining in the electrolytic plating bath 161 without reacting with a copper cyanide.

TABLE 2

| Plating solution composition | Chemical formula | Concentration (g/l) |
|---|---|---|
| Cuprous cyanide | CuCN | 20-80 |
| Sodium cyanide (potassium cyanide) | NaCN (KCN) | 25-130 |
| Free sodium cyanide (free potassium cyanide) | NaCN (KCN) | 5-25 |
| Potassium sodium tartrate | $KNaC_4H_4O_6 \cdot 4H_2O$ | 15-60 |
| Sodium carbonate (potassium carbonate) | $Na_2CO_3$ ($K_2CO_3$) | 10-30 |
| Potassium hydroxide (sodium hydroxide) | KOH (NaOH) | 10-20 |

First, about 60% pure water by volume of the entire plating solution, with impurities such as sulfur or chlorine or the like removed therefrom, is put into another bath. Next, a sodium cyanide or a potassium cyanide is added to the pure water and dissolved therein to form an alkali cyanide aqueous solution. Further, a cuprous cyanide made into a paste by using the pure water is added to the alkali cyanide aqueous solution, which is agitated and dissolved therein. Further, for the purpose of suppressing the occurrence of a cyan decomposition, a potassium hydroxide or a sodium hydroxide is added to the plating solution to adjust the pH of the plating solution or the electrical conductivity of the plating solution. Next, with the plating solution being heated to from 40 to 70 degrees C., which is close to the temperature of the plating solution during the plating treatment, an activated carbon or the like is added thereto and sufficiently agitated, and is thereafter allowed to stand to allow the activated carbon with impurities adsorbed thereon to settle out. Thereafter, the plating solution is passed through a filtering device to remove the activated carbon or the like with the impurities captured by them, and is then poured into the electrolytic plating bath 161, followed by adding pure water thereto to adjust the amount of the plating solution, resulting in the copper cyanide plating solution.

Next, this resulting copper cyanide plating solution is analyzed, and if desired, an additive agent is added thereto to ensure an enhancement and a stabilization in plating performance Specifically, a proper amount of a sodium carbonate or a potassium carbonate is added thereto as a pH buffer or adjuster. Further, a potassium sodium tartrate (a Rochelle salt) is added thereto to smoothly dissolve the copper anode and efficiently provide copper ions. Finally, a stainless steel plate is hung as a cathode while a rolled copper plate to be used for plating is hung as an anode, and a weak electrolysis is performed with a weak current density (0.2 to 0.5 $A/dm^2$).

When the copper cyanide plating solution is used as the electrolytic plating solution 162 to form a Cu atom (metal) from a Cu ion, a reaction represented by chemical equation 2 below occurs. Chemical equation 2 represents that a monovalent Cu cation gains a single electron to become a Cu atom (metal).

$$Cu^{+}+e^{-}\rightarrow Cu \quad \text{[Equation 4]}$$

In the reaction represented by chemical equation 4, since one electron becomes necessary for one Cu ion, the amount of electric charges necessary to produce 1 mol of Cu is approximately 96,485 C (corresponding to the Faraday constant) which is the product of the elementary electric charge and the Avogadro constant. For this reason, in light of the atomic mass of copper being 63.54, the amount of electric charges necessary to form 1 g of copper is about 1,518 C/g.

As shown by chemical equation 5 below, the current i is expressed in terms of the amount of electric charges Q and the time t. For this reason, if the electrolytic platings are the same in electric current density, in principle, when using the copper cyanide plating solution including the low valence (valence+1) copper ions as the electrolytic plating solution 162, it is possible to form the shield 12 made of the plating layer in half the time taken when using the copper sulfate plating solution. For that reason, if the use voltage and electric current during the electrolytic plating are constant, the power consumption, which is directly related to the plating time, is considered to become half, and the energy cost can therefore be lowered. In addition, since the factory operation time in the electrolytic plating treatment step becomes half, a substantial reduction in labor cost for number produced can be expected.

$$i=dQ/dt \quad \text{[Equation 5]}$$

Note that the plating solution to be able to be used as the electrolytic plating solution 162 is not limited to the copper sulfate plating solution or copper cyanide plating solution as described above, but may be, e.g., a copper fluoroborate plating solution, which is produced by mixing $Cu(BF_4)_2$, $HBF_4$, a Cu metal and the like together, or a copper pyrophosphate plating solution, which is produced by mixing $Cu_2P_2O_7.3H_2O$, $K_4P_2O_7.3H_2O$, $NH_4OH$, KNOB, a Cu metal, and the like together. Further, the plating solution to be able to be used as the electrolytic plating solution 162 may be a plating solution, which is produced by combining together 2 or more types of plating solutions of the above mentioned plating solutions.

The one pair of anodes 163 are being immersed in the electrolytic plating solution 162. The one pair of anodes 163 act as a provider of the copper ions in electrolytic plating, and is the ones each produced by casting and rolling a molten copper (a crude copper including a purity of about 99%) produced from a copper melt, for example. Alternatively, a stripped off copper plate (electrolytic copper) may be used as the one pair of anodes 163, which is made of a copper with an enhanced purity produced by performing a starting sheet electrolysis with the crude copper to be used as an anode and a stainless steel or titanium plate or the like to be used as a cathode, and stripping off the copper deposited on the cathode surface.

The bobbin **170*k* and the bobbin 170*m* located over the electrolytic plating bath 161 are electrically conductive and function as the cathodes. The bobbin 170*l* located in the electrolytic plating solution 162 is electrically insulative. The power supply unit 164 applies a DC voltage to between the anodes 163 and the bobbins 170*k* and 170*m*** which act as the cathode bobbins.

With the DC voltage being applied to between the anodes 163 and the bobbin **170*k* and the bobbin 170*m*, the cable 2** is transferred to and passed through the electrolytic plating solution 162, to thereby form the electrolytic plating layer on the electroless plating layer on the surface of the electrical insulating body 11, resulting in the shield 12.

Note that the transfer mechanism of the cable 2 in the electrolytic plating unit 160 is not limited to the one using the bobbin 170*k*, the bobbin 170*l*, and the bobbin 170*m*. For example, the transfer mechanism of the cable 2 in the electrolytic plating unit 160 may be such a mechanism as to, instead of providing the bobbin mechanism in the electrolytic plating solution 162, transfer the cable 2 by bending the cable 2 into a shape including a predetermined curvature or a large number of curvatures, and passing the bent cable 2 through the electrolytic plating solution 162 in such a manner as to press out the bent cable 2 from one side, while pulling the bent cable 2 from the other side. Furthermore, without providing the transfer mechanism, the electrolytic plating may be performed by immersing the bundled cable 2 in the electrolytic plating solution 162, and then connecting the bundled cable 2 to a cathode electrode, and properly rocking the bundled cable 2 to thereby bring the entire surface of the bundled cable 2 into contact with the electrolytic plating solution 162.

Next, one example of a process flow for forming the shield 12 using the shield forming system 100 will be described.

First, the cable 2 composed of the two conductors 10 and the electrical insulating body 11 provided over the periphery of the two conductors 10 is immersed in the degreasing liquid 112 in the degreasing unit 110 for 3 to 5 minutes. The temperature of the degreasing liquid 112 at this point of time is from 40 to 60 degrees C., for example. This results in removal of the grease adhering to the surface of the electrical insulating body 11 of the cable 2.

Note that, in the subsequent surface treatment step for the electrical insulating body 11 of the cable 2, when performing the treatment on the surface of the electrical insulating body 11 of the cable 2, such as the roughening treatment by the blasting method or the like, which has the effect of removing the grease and the like adhering to the surface of the electrical insulating body 11 of the cable 2, it is possible to omit the degreasing step in the degreasing unit 110.

Next, in the surface treatment unit 120, the cable 2 is subjected to the roughening treatment by the blasting treatment and the modification treatment by the corona discharge exposure as the surface treatment for the cable 2.

In the blasting treatment for the surface roughening treatment for the cable 2, a blasting medium such as dry ice or the like is blasted from a blasting nozzle of a blasting device which is one example of the surface treatment device 121 to roughen the surface of the electrical insulating body 11 of the cable 2.

In the blasting treatment, in order to achieve the desired magnitude of the average irregularities spacing Sm or the mean spacing of local peaks S of the irregularities of the surface of the electrical insulating body 11, it is possible to appropriately adjust the particle diameter of the blasting medium, the blasting pressure, the distance between the blasting nozzle tip of the blasting device and the electrical insulating body 11, or the like. For example, when the dry ice blasting treatment is performed, the particle diameters of dry ice particles are set in a range of 0.3 to 3 mm, while the distance from the surface of the electrical insulating body 11 to the tip of the blasting nozzle is set in a range of 0 to 10 cm. Further, the dry ice blasting treatment is performed under a temperature condition within a range of −80 degrees C. to room temperature.

In the corona discharge exposure for the surface modification treatment for the cable 2, in a corona treatment device which is one example of the surface treatment device 121, a high frequency high voltage is applied to between one pair of flat plate electrodes installed with the cable 2 sandwiched therebetween to produce a corona discharge. This results in the modification of the region or the entire region of the aforementioned predetermined depth from the surface of the electrical insulating body 11 of the cable 2, to hydrophilize the surface of the electrical insulating body 11 and thereby enhance the wettability of the surface of the electrical insulating body 11. The corona treatment device may be provided with two or more sets of the one-pairs of flat plate electrodes.

In the corona discharge exposure, in order to achieve the desired magnitude of the degree of crystallization, Xc, of the electrical insulating body 11, for example, when using a device of a type that corona discharge light is radiated from a discharge probe, it is possible to appropriately adjust the voltage output, the distance between the surface of the electrical insulating body 11 and the tip of the discharge probe, the number of scans with the discharge probe, the exposure time, or the like. Specifically, the higher the voltage output, the higher the degree of crystallization, Xc. Also, the shorter the distance between the surface of the electrical insulating body 11 and the tip of the discharge probe, the higher the degree of crystallization, Xc. Also, the more the number of scans with the discharge probe, the higher the degree of crystallization, Xc. Also, the longer the exposure time, the higher the degree of crystallization, Xc. For example, with the voltage output being set at about 9 kV, the distance between the surface of the electrical insulating body 11 and the tip of the discharge probe being set at several tens of mm, and the scanning speed of the discharge probe being set at 0.15 to 15 mm/sec, the corona discharge exposure is performed at room temperature in an atmosphere.

Next, in the first activation unit 130, the cable 2 is immersed in the first activation liquid 132 for 1 to 3 minutes. The temperature of the first activation liquid 132 is, e.g., from 30 to 40 degrees C. This results in formation of a catalytically active layer on the surface of the electrical insulating body 11. Specifically, for example, by using a colloidal solution of Pd—Sn particles as the first activation liquid 132, the Pd—Sn particles containing Pd exhibiting a high catalytic activity are attached to the surface of the electrical insulating body 11, resulting in the formation of the catalytically active layer on the surface of the electrical insulating body 11.

Next, in the second activation unit 140, the cable 2 is immersed in the second activation liquid 142 for 3 to 6 minutes. The temperature of the second activation liquid 142 is, e.g., from 30 to 50 degrees C. This makes it possible to, e.g., remove Sn, which lowers the degree of activity, from the catalytically active layer on the surface of the electrical insulating body 11, and thereby increase the degree of activity of the catalytically active layer.

Next, in the electroless plating unit 150, the cable 2 is immersed in the electroless plating solution 152 for a period of time of not more than 10 minutes. The temperature of the electroless plating solution 152 is from 20 to 30 degrees C., for example. This results in formation of an electroless plating layer as a seed layer for electrolytic plating on the surface of the electrical insulating body 11, making the surface of the electrical insulating body 11 electrically conductive. The longer the immersion time in the electroless plating solution 152, the greater the thickness of the electroless plating layer.

Next, in the electrolytic plating unit 160, the cable 2 is immersed in the electrolytic plating solution 162 for a period of time of not more than 3 minutes. The thickness of the resulting electrolytic plating layer can be controlled by the transfer speed for the cable 2 or the immersion time for the cable 2 in the electrolytic plating solution 162. The transfer speed for the cable 2 or the immersion time for the cable 2 is optimized in light of the electric current density, the concentration of the electrolytic plating solution 162 in the electrolytic plating bath 161, the pH of the electrolytic plating solution 162 in the electrolytic plating bath 161, the temperature of the electrolytic plating solution 162 in the electrolytic plating bath 161, the types of the additive agents, and the like, according to the shielding performance of the shield 12, the management status for the electrolytic plating solution 162 in the electrolytic plating bath 161, the change over time of the electrolytic plating solution 162 in the electrolytic plating bath 161, and the like.

Examples of the specific conditions for the electrolytic plating in the electrolytic plating unit 160 are shown in Table 3 below. The "bath temperature" and the "bath voltage" shown in Table 3 are the temperature of the electrolytic plating solution 162 in the electrolytic plating bath 161, and the voltage applied to between the anodes 163 in the electrolytic plating bath 161, and the bobbin 170*k* and the bobbin 170*m*, which act as the cathodes, respectively.

TABLE 3

| Items | Conditions |
|---|---|
| Bath temperature (° C.) | 20-30 |
| Cathode current density (A/dm$^2$) | 1-6 |
| Anode current density (A/dm$^2$) | −2.5 |
| Bath voltage (V) | 1-6 |
| Agitation method | Air agitation |
| Filtration | Continuous filtration, 3 times/hour or more |
| Anode | Phosphorus containing copper |
| Anode bag | Saran cloth, or the like |

The above-described electrolytic plating results in the formation of the electrolytic plating layer on the surface of the electroless plating layer. The shield 12 is configured as a layered member with the electroless plating layer and the electrolytic plating layer being layered therein. By, in turn, performing the above-described steps of the method for producing the cable 1, the cable 1 according to the present embodiment is produced.

Note that, although not shown in FIG. 2, it is preferable to perform a cleaning (an ultrasonic cleaning, a swing cleaning, a running water cleaning or the like) of the cable 2 with pure water before performing the subsequent steps described above so that no failure is caused by the remaining chemical agents used in the previous steps.

Also, in order to achieve the transfer speeds of the cable 2 which are each suitable for each of the above-described treatments to be performed in the steps, respectively, of the method for producing the cable 1, it is preferable that, for each of the bobbins 170*a* to 170*m*, the respective number of rotations is optimized by adjusting the respective gear ratio (the respective rotation radius). For that reason, it is preferable that a respective rotation mechanism with a respective buffer is installed between adjacent ones of the units 110, 120, 130, 140, 150, and 160, so as to be able to optionally perform a transfer speed alteration or a temporary standby operation in the production lines between the production steps described above.

(Advantageous Effects of the Embodiment)

In the cable 1 according to the above embodiment, since the roughening treatment or the modification treatment is performed as the surface treatment for the electrical insulating body 11, it is possible to enhance the strength of the adhesion between the overlying shield 12 made of the plating layer and the underlying electrical insulating body 11, and it is possible to suppress the occurrence of a peeling of the plating layer (the shield 12) from the electrical insulating body 11, or the occurrence of a degradation in the transmission properties of the cable 1 due to the formation of an air gap between the plating layer (the shield 12) and the electrical insulating body 11.

Note that the method for enhancing the strength of the adhesion between the electrical insulating body 11 and the plating layer (the shield 12) in the above embodiment can be applied to a general linear shape member of a cable or a waveguide or the like, having a linear shape electrical insulating body formed with a plating layer on a surface thereof. For example, in a waveguide as disclosed in Japanese Patent Application Laid-Open No. 2017-228839, when forming a conductor layer by plating treatment on a dielectric layer coating a linear shape foamed dielectric body, by applying the method of the above embodiment, it is possible to enhance the strength of the adhesion between the dielectric layer and the conductor layer.

Example 1

The cable 1 according to the above embodiment was produced, and surface profile irregularities (projections and neighboring depressions) of the surface of the electrical insulating body 11 were evaluated. The cable 1 produced in the present embodiment was a differential signaling cable having a twinaxial structure, and had the two conductors 10 each being made of a copper, the electrical insulating body 11 made of a polyethylene, and the shield 12 made of a copper plating layer.

The surfaces of the electrical insulating bodies 11 made of the polyethylene were subjected to the roughening treatments in various conditions, and the surface profile irregularities of the surfaces of the electrical insulating bodies 11 were evaluated. Further, the shield 12 was formed on the surface of each of the electrical insulating bodies 11 by electroless plating and electrolytic plating, and the relationships between the states of the surface profile irregularities of the surfaces of the electrical insulating bodies 11 and the strengths of the adhesions between the underlying electrical insulating bodies 11 and the overlying shields 12 were investigated.

Figure 3A:
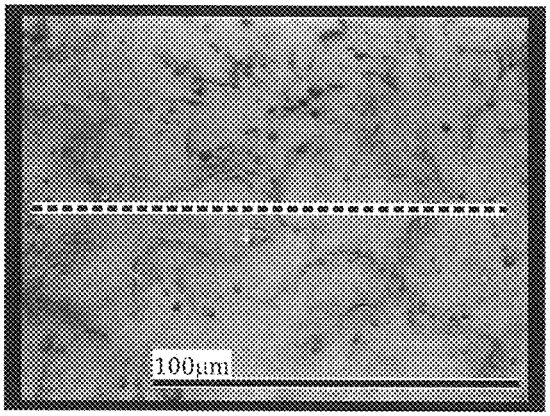
FIG. 3A is a scanning electron microscope observation image showing a surface of an electrical insulating body film subjected to a dry ice blasting treatment.
Figure 3B:
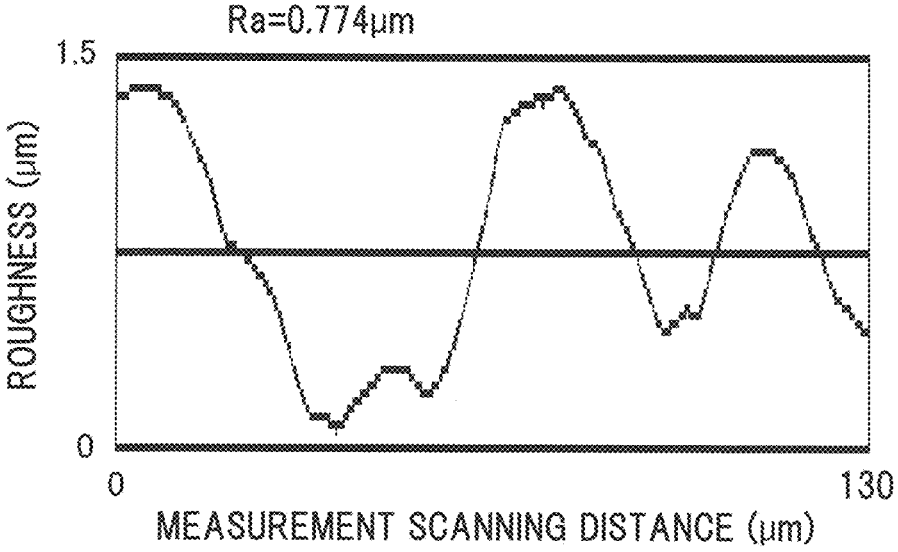
FIG. 3B is a graph showing surface profile irregularities of the surface of the electrical insulating body film along a straight line shown in FIG. 3A.

FIG. 3A is an image observed with a laser microscope (VK-8500, available from Keyence Corporation), showing the surface of the electrical insulating body 11 formed with the surface irregularities thereon during extrusion molding, and FIG. 3B is a graph showing surface profile irregularities (a roughness curve), along a dotted line shown in FIG. 3A, of the surface of the electrical insulating body 11 measured with the above mentioned laser microscope. The dotted line shown in FIG. 3A was drawn along a length direction of the cable 1. This was intended to suppress the influence of the curvature of the cable 1 on the irregularities of the surface of the electrical insulating body 11 to be measured.

The arithmetic mean roughness Ra of the surface of the electrical insulating body 11 calculated from the graph of FIG. 3B was 0.774 μm. Further, the value of the average irregularities spacing Sm of the irregularities was 50.8 μm, while the value of the mean spacing of local peaks S of the irregularities was 7.0 μm. These values were measured with the function of the laser microscope described above.

Then, the surface of the electrical insulating body 11 as shown in FIGS. 3A and 3B was subjected to the modification treatment by the corona discharge exposure at a room temperature in an air atmosphere with the number of scans with the discharge probe being set at three, which was followed by the formation of the shield 12 on the surface of the electrical insulating body 11, but a peeling of the shield 12 from the electrical insulating body 11 was easily caused because the strength of the adhesion between the electrical insulating body 11 and the shield 12 was low.

Figure 4A:
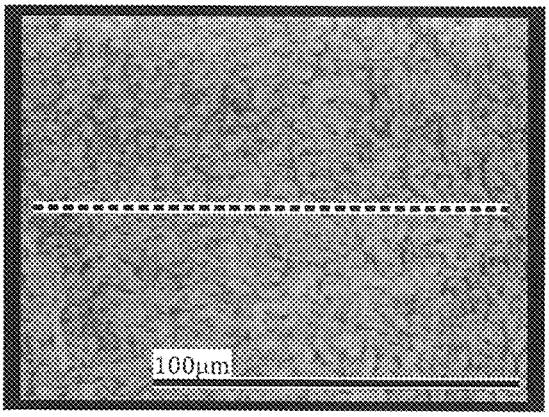
FIG. 4A is a scanning electron microscope observation image showing a surface of an electrical insulating body film subjected to the dry ice blasting treatment.
Figure 4B:
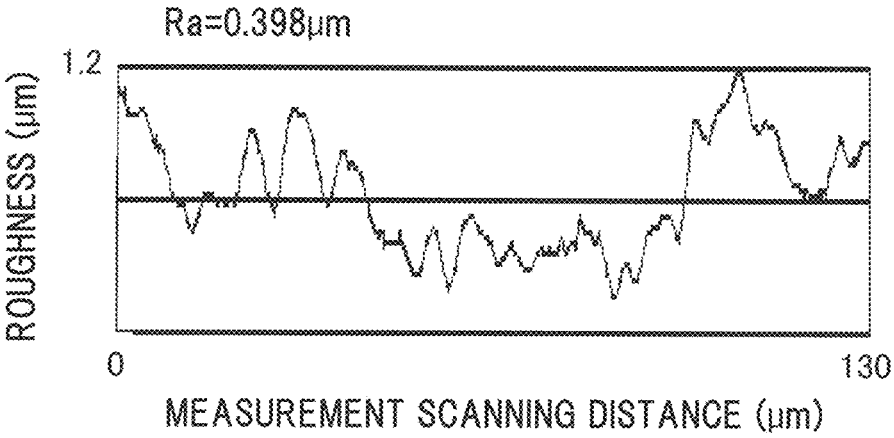
FIG. 4B is a graph showing surface profile irregularities of the surface of the electrical insulating body film along a straight line shown in FIG. 4A.

FIG. 4A is an image observed with a laser microscope (VK-8500, available from Keyence Corporation), showing the surface of the electrical insulating body 11 subjected to the dry ice blasting treatment with the blasting pressure being set at 0.6 MPa and the scanning speed of the blasting nozzle of the blasting device being set at 10 mm/s, and FIG. 4B is a graph showing surface profile irregularities (a roughness curve), along a dotted line shown in FIG. 4A, of the surface of the electrical insulating body 11 measured with the above mentioned laser microscope. The dotted line shown in FIG. 4A was drawn along the length direction of the cable 1. This was intended to suppress the influence of the curvature of the cable 1 on the irregularities of the surface of the electrical insulating body 11 to be measured.

The arithmetic mean roughness Ra of the surface of the electrical insulating body 11 calculated from the graph of FIG. 4B was 0.398 μm. Further, the value of the average irregularities spacing Sm of the irregularities was 8.4 μm, and the value of the mean spacing of local peaks S of the irregularities was 2.6 μm. These values were measured with the function of the laser microscope described above.

Then, the surface of the electrical insulating body 11 as shown in FIGS. 4A and 4B was subjected to the modification treatment by the corona discharge exposure at a room temperature in an air atmosphere with the number of scans with the discharge probe being set at three, which was followed by the formation of the shield 12 on the surface of the electrical insulating body 11. As a result, the shield 12 was not easily peeled from the electrical insulating body 11 because the strength of the adhesion between the electrical insulating body 11 and the shield 12 was high.

In comparison between the electrical insulating body 11 as shown in FIGS. 3A and 3B and the electrical insulating body 11 as shown in FIGS. 4A and 4B, the electrical insulating body 11 as shown in FIGS. 3A and 3B and the electrical insulating body 11 as shown in FIGS. 4A and 4B were different in the arithmetic mean roughness Ra, the average irregularities spacing Sm of the irregularities, and the mean spacing of local peaks S of the irregularities.

In general, it had been being considered that the higher the arithmetic mean roughness Ra, the higher the anchor effect produced, and therefore, from this point of view, the electrical insulating body 11 as shown in FIGS. 3A and 3B being high in the arithmetic mean roughness Ra had been considered to be higher in the strength of the adhesion to the shield 12 than the electrical insulating body 11 as shown in FIGS. 4A and 4B. However, the result of the above evaluation showed that the electrical insulating body 11 as shown in FIGS. 4A and 4B was higher in the strength of the adhesion to the shield 12 than the electrical insulating body 11 as shown in FIGS. 3A and 3B.

This result showed that the strength of the adhesion between the electrical insulating body 11 and the shield 12 was more greatly affected by the average irregularities spacing Sm or the mean spacing of local peaks S of the irregularities of the surface of the electrical insulating body 11 than by the arithmetic mean roughness Ra of the surface of the electrical insulating body 11. This was considered to be because the smaller the average irregularities spacing Sm or the mean spacing of local peaks S of the irregularities of the surface of the electrical insulating body 11, the higher the anchor effect produced by the copper plating layer passing into the depressed portions of the surface of the electrical insulating body 11.

Further, the electrical insulating body 11 was subjected to the dry ice blasting treatment with the blasting pressure being set at 0.6 MPa and the scanning speed of the blasting nozzle of the blasting device being set at 100 mm/s, and its surface profile irregularities (projections and neighboring depressions) were observed along the length direction of the cable 1 with the above mentioned laser microscope. As a result, the arithmetic mean roughness Ra was 0.18 μm. In addition, in each of two measurement regions along the length direction of the cable 1, the values for the average irregularities spacing Sm and the mean spacing of local peaks S were measured. As a result, in the first measurement region, the values for the average irregularities spacing Sm and the mean spacing of local peaks S of the spacings were 12.6 μm and 2.4 μm, respectively, while in the second measurement region, the values for the average irregularities spacing Sm and the mean spacing of local peaks S were 16.4 μm and 2.8 μm, respectively.

Thereafter, the surface of the electrical insulating body 11 was subjected to the modification treatment by the corona discharge exposure with the applied voltage being set at 12 kV, the scanning speed of the discharge probe being set at 15 mm/s, the number of scans with the discharge probe being set at 16. As a result, the contact angle of the plating solution dropped on the electrical insulating body 11 was 44.5 degrees, which resulted in the high wettability of the electrical insulating body 11. Thereafter, the copper plating layer was formed on the electrical insulating body 11 as the shield 12. As a result, the strength of the adhesion between the electrical insulating body 11 and the shield 12 was high, and therefore the shield 12 was not easily peeled from the electrical insulating body 11.

From the results of these tests and the like, it was confirmed that the strength of the adhesion between the electrical insulating body 11 and the shield 12 was greatly enhanced by the roughening treatment reducing the average irregularities spacing Sm of the irregularities of the surface of the electrical insulating body 11 to not more than 20.0 μm. In addition, it was confirmed that the strength of the adhesion between the electrical insulating body 11 and the shield 12 was greatly enhanced by reducing the mean spacing of local peaks S of the irregularities to not more than 3.0 μm.

Example 2

The cable 1 according to the above embodiment was produced and its properties were evaluated. The cable 1 produced in the present embodiment was a differential signaling cable having a twinaxial structure, and had the two conductors 10 each being made of a copper, the electrical insulating body 11 made of a polyethylene, and the shield 12 made of a copper plating layer.

Further, the electrical insulating body 11 of the cable 1 was subjected to the roughening treatment by the dry ice blasting treatment and the modification treatment by the corona discharge exposure as the surface treatment before the shield 12 was formed.

For the dry ice blasting treatment, Super Blast DSC-V Reborn and DSC-I, which were dry ice cleaning devices available from Kyodo International Co., Ltd., were used. The particle diameters of the dry ice particles were set in the range of 0.3 to 3 mm. The blasting pressure of the dry ice was set at 0.5 MPa or 0.35 MPa. Further, the dry ice blasting treatment was performed under a temperature condition within a range of from −80 degrees C. to a room temperature.

For the corona discharge exposure, Coronafit (CFA-500 type) which was a corona discharge surface modification device available from Shinko Electric Instrumentation Co., Ltd. was used. The electrical insulating body 11 was exposed to corona discharge light in an atmosphere at a room temperature with the voltage output being set at about 9 kV, and the distance between the surface of the electrical insulating body 11 and the tip of the discharge probe being set at several tens of mm (Evaluation of the Degree of Crystallization of the Electrical Insulating Body)

After the surface treatment, before forming the shield 12, the degree of crystallization of the electrical insulating body 11 was investigated by the ATR measurement.

For the measurement, a composite device of IRT7000 and FT/IR6200 available from JASCO Corporation was used. Also, a Ge crystal having a refractive index of 4.0 was used as the ATR crystal which was a high refractive index medium. The incident angle of infrared light was set at 45 degrees. The reflected light was measured with a linear array MCT detector, and the actual observation of the surface to be measured was performed with a 16 magnification Cassegrain mirror. The number of integrations in the measurement was set at 2000, and the wave number resolution was set at 2 $cm^{-1}$.

Figure 5A:
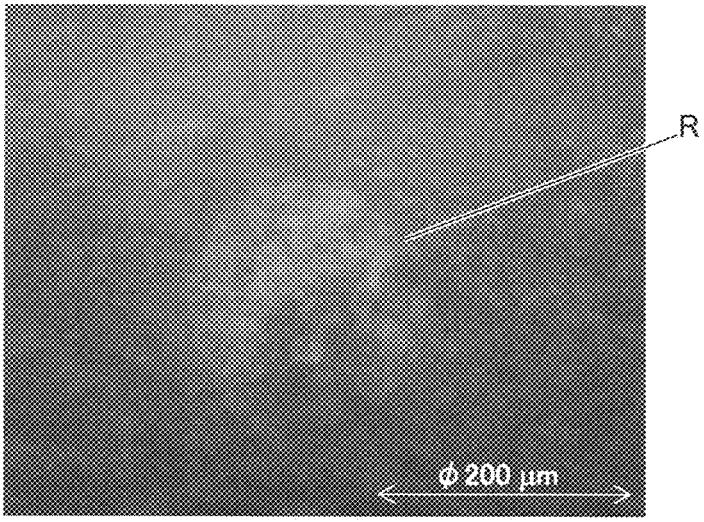
FIGS. 5A, 5B and 5C are photographs showing a measurement region R for an ATR measurement of the surface of the electrical insulating body.
Figure 5B:
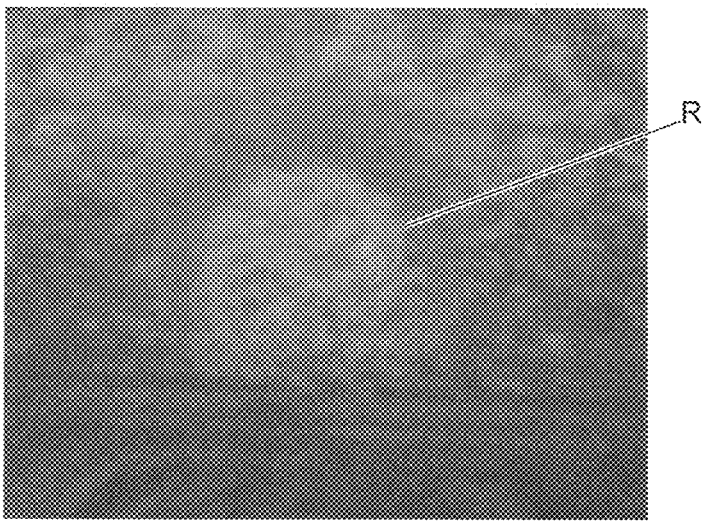
Figure 5C:
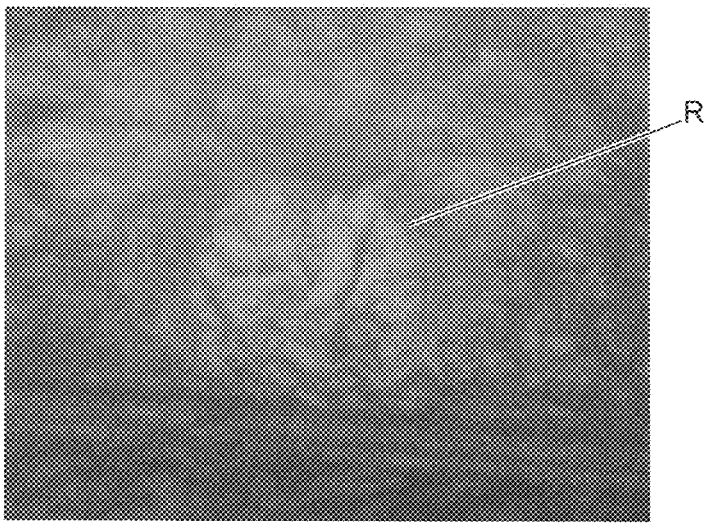

FIGS. 5A to 5C are photographs showing a measurement region R for the ATR measurement for the surface of the electrical insulating body 11. The measurement region R was an indentation portion against which the ATR crystal was pressed, and was a circular region having a diameter of about 200 μm.

Figure 6A:
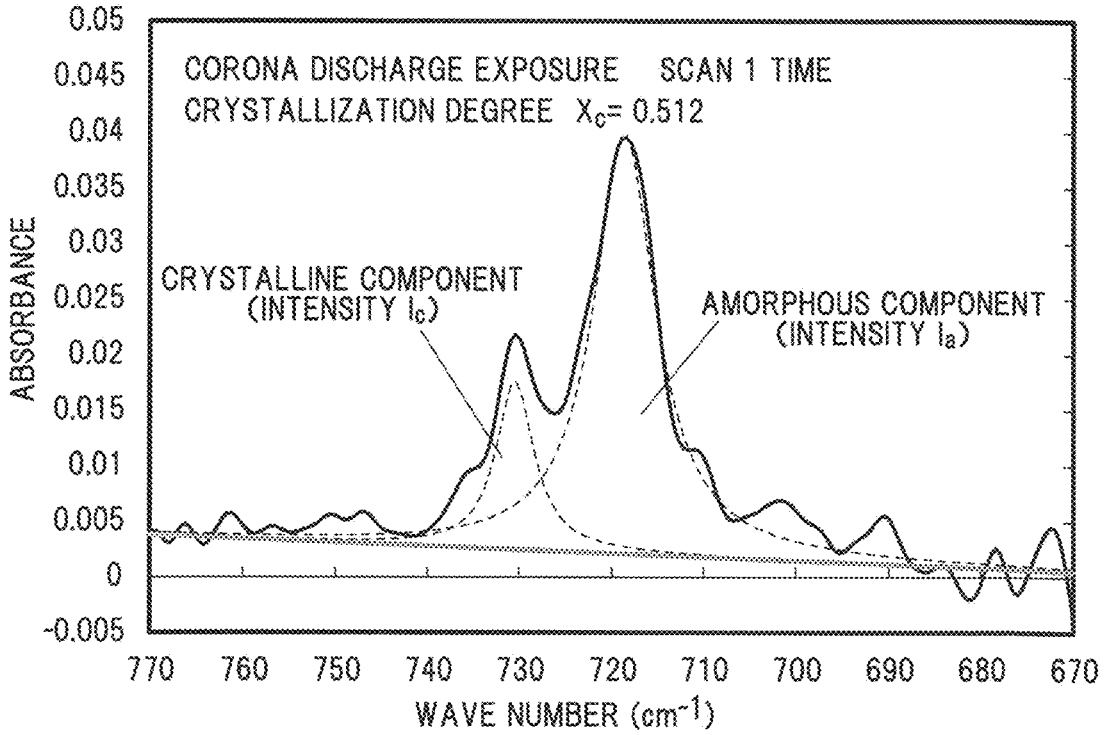
FIGS. 6A and 6B show an ATR spectrum in an electrical insulating body subjected to the dry ice blasting treatment.
Figure 6B:
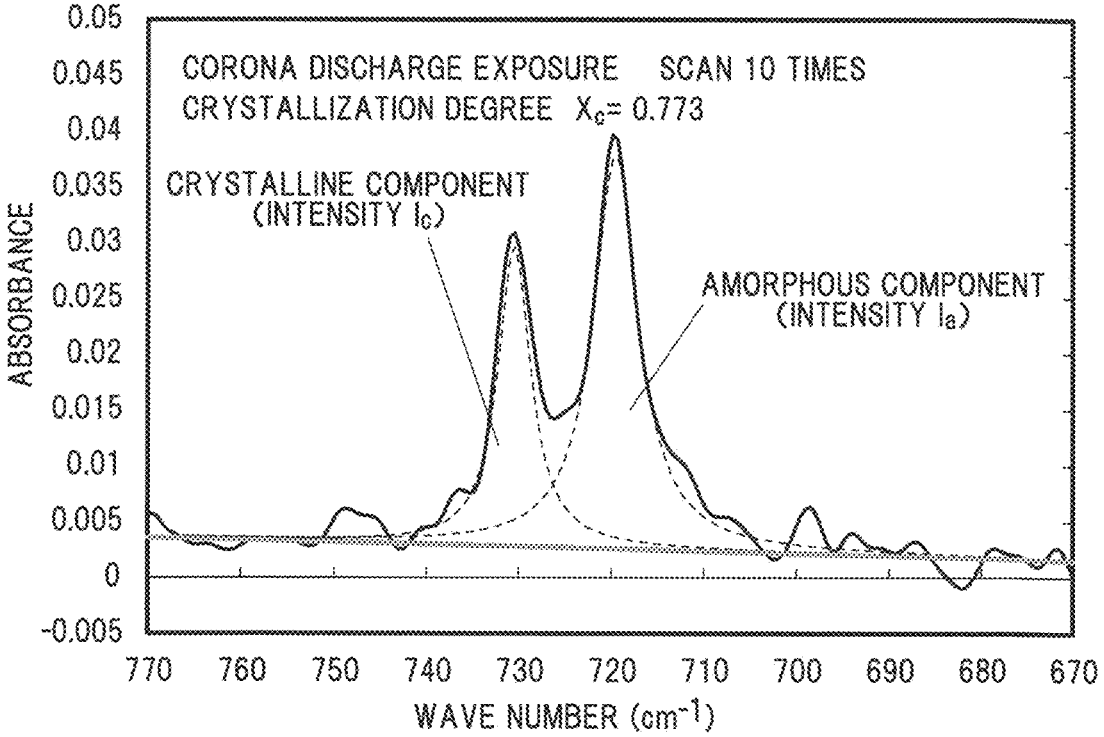

FIGS. 6A and 6B show spectra (ATR spectra) obtained by the ATR measurement of the electrical insulating body 11 subjected to the dry ice blasting treatment with the dry ice blasting pressure being set at 0.5 MPa. The horizontal axis in FIG. 6 is the wave number, while the vertical axis in FIG. 6 is the absorption (reflection) intensity. The peak at a wave number of about 730 $cm^{-1}$ was ascribed to the crystalline component of the polyethylene constituting the electrical insulating body 11. The peak at a wave number of about 720 $cm^{-1}$ was ascribed to the amorphous component of the polyethylene constituting the electrical insulating body 11.

The ATR spectrum shown in FIG. 6A was obtained by measuring the electrical insulating body 11 subjected to the modification treatment by the exposure to corona discharge 1 time.

Smooth mounded curves indicated by dotted lines in FIG. 6A are fitting curves which were obtained by fitting being performed on the ATR spectrum, and the fitting curve for the peak of the amorphous component and the fitting curve for the peak of the crystalline component were both well coincident with the ATR spectrum. For the fitting, a Lorentz function f(x) represented by the following equation 6 was used.

$$f(x) = \frac{h}{\left\{1 + \left(\frac{x-u}{w/2}\right)^2\right\}} + ax + b \qquad \text{[Equation 6]}$$

The h in the equation 6 is the height (the intensity) of the infrared absorption peak. Also, the u in the equation 6 is the position (the wave number) of the infrared absorption peak. The w in the equation 6 is the full width at half maximum of the infrared absorption peak. The a in the equation 6 is the slope coefficient of the linear function for background correction. The b in the equation 6 is the intercept coefficient of the linear function for background correction. Although the linear function expression in the second term of the equation 6 is the background correction expression, the background correction expression is not limited to this linear function expression, but a function expression such as a second degree or higher degree nonlinear function expression or the like may be used in the background correction expression.

For the above mentioned fitting curve for the peak of the amorphous component and the above mentioned fitting curve for the peak of the crystalline component, the integral intensity calculations were performed to obtain the absorption peak intensity Ia for the amorphous component and the absorption peak intensity Ic for the crystalline component, respectively. The integral intensity calculations were performed in the range of the wave number of from 670 to 770 $cm^{-1}$.

The calculated absorption peak intensity Ia for the amorphous component and the calculated absorption peak intensity Ic for the crystalline component were 46.0 and 11.4, respectively, and the degree of crystallization, Xc, calculated from the equation 1 using these values was 0.512.

The ATR spectrum shown in FIG. 6B was obtained by measuring the electrical insulating body 11 subjected to the modification treatment by the exposure to corona discharge 10 times.

For the ATR spectrum shown in FIG. 6B, the integral intensity calculations for the fitting curves for the amorphous component and the crystalline component were performed in the same manner as for the ATR spectrum shown in FIG. 6A. As a result, the calculated absorption peak intensity Ia for the amorphous component and the calculated absorption peak intensity Ic for the crystalline component were 31.3 and 17.6, respectively, and the degree of crystallization, Xc, calculated from the equation 1 using these values was 0.773.

In addition, for the electrical insulating body 11 subjected to the dry ice blasting treatment with the dry ice blasting pressure being set at 0.5 MPa and the subsequent modification treatment by the exposure to corona discharge 5 times, the degree of crystallization, Xc, was measured in the same manner as described above. As a result, the value of the degree of crystallization, Xc, was 0.685.

From these measurement results on the degrees of crystallization Xc, for the electrical insulating body 11 subjected to the dry ice blasting treatment with the dry ice blasting pressure being set at 0.5 MPa, it was confirmed that the degree of crystallization, Xc, of the electrical insulating body 11 was able to be adjusted and set at the desired value according to the conditions for the corona discharge exposure treatment.

Figure 7A:
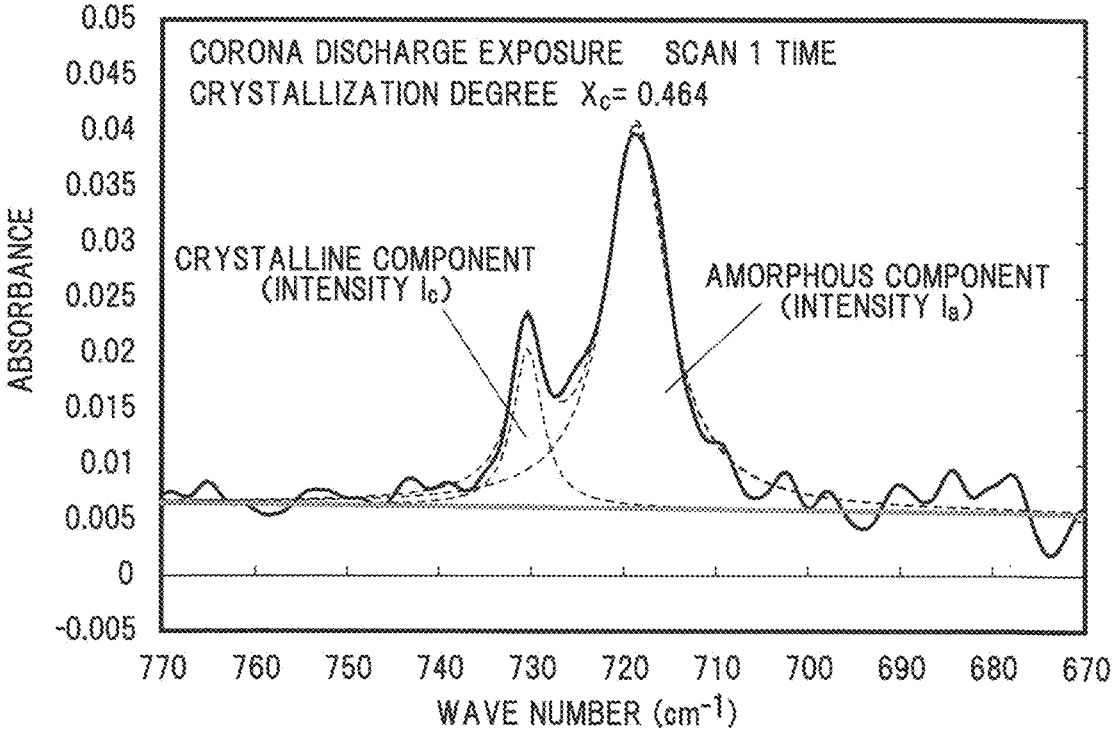
FIGS. 7A and 7B show an ATR spectrum in an electrical insulating body subjected to the dry ice blasting treatment.
Figure 7B:
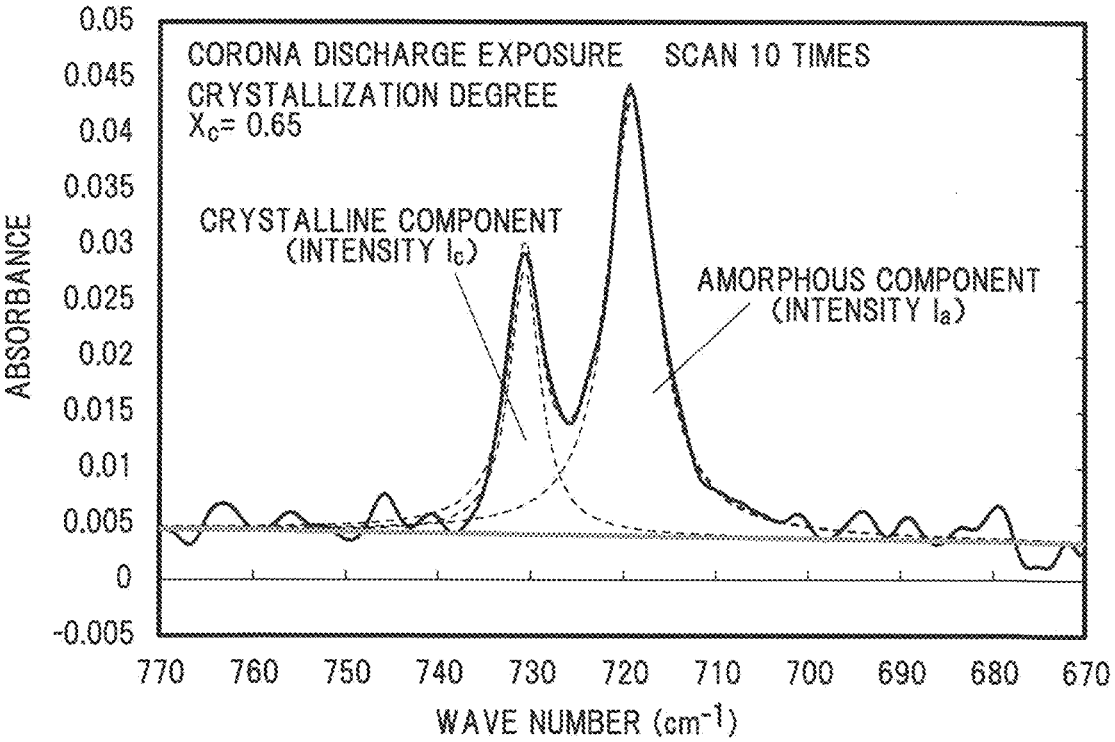

FIG. 7A and FIG. 7B show ATR spectra in the electrical insulating body 11 subjected to the dry ice blasting treatment with the dry ice blasting pressure being set at 0.35 MPa.

The ATR spectrum shown in FIG. 7A was obtained by measuring the electrical insulating body 11 subjected to the modification treatment by the exposure to corona discharge 1 time.

For the ATR spectrum shown in FIG. 7A, the integral intensity calculations for the fitting curves for the amorphous component and the crystalline component were performed in the same manner as for the ATR spectrum shown in FIG. 6A. As a result, the calculated absorption peak intensity Ia for the amorphous component and the calculated absorption peak intensity Ic for the crystalline component were 40.5 and 8.3, respectively, and the degree of crystallization, Xc, calculated from the equation 1 using these values was 0.464.

The ATR spectrum shown in FIG. 7B was obtained by measuring the electrical insulating body 11 subjected to the modification treatment by the exposure to corona discharge 10 times.

For the ATR spectrum shown in FIG. 7A, the integral intensity calculations for the fitting curves for the amorphous component and the crystalline component were performed in the same manner as for the ATR spectrum shown in FIG. 6A. As a result, the calculated absorption peak intensity Ia for the amorphous component and the calculated absorption peak intensity Ic for the crystalline component were 36.8 and 14.6, respectively, and the degree of crystallization, Xc, calculated from the equation 1 using these values was 0.65.

Further, for the electrical insulating body 11 subjected to the dry ice blasting treatment with the dry ice blasting pressure being set at 0.35 MPa and the subsequent modification treatment by the exposure to corona discharge 5 times, the degree of crystallization, Xc, was measured in the same manner as described above. As a result, the value of the degree of crystallization, Xc, was 0.647.

From these measurement results on the degrees of crystallization Xc, for the electrical insulating body 11 subjected to the dry ice blasting treatment with the dry ice blasting pressure being set at 0.35 MPa, it was confirmed that the degree of crystallization, Xc, of the electrical insulating body 11 was able to be adjusted and set at the desired value according to the conditions for the corona discharge exposure treatment.

From the measurement results of the degrees of crystallization, Xc, of the electrical insulating body 11 subjected to the dry ice blasting treatment with the dry ice blast pressure set at 0.5 MPa and the electrical insulating body 11 subjected to the dry ice blasting treatment with the blasting pressure of the dry ice set at 0.35 MPa, even when there was the difference in the dry ice blasting pressure, it was confirmed that the degree of crystallization, Xc, of the electrical insulating body 11 was able to be adjusted and set at the desired value according to the conditions for the corona discharge exposure treatment. That is, it was confirmed that the degree of crystallization Xc of the electrical insulating body 11 was able to be adjusted and set at the desired value according to the conditions for the corona discharge exposure treatment, regardless of the states of the irregularities of the surface of the electrical insulating body 11 resulting from the roughening treatment.

Figure 8A:
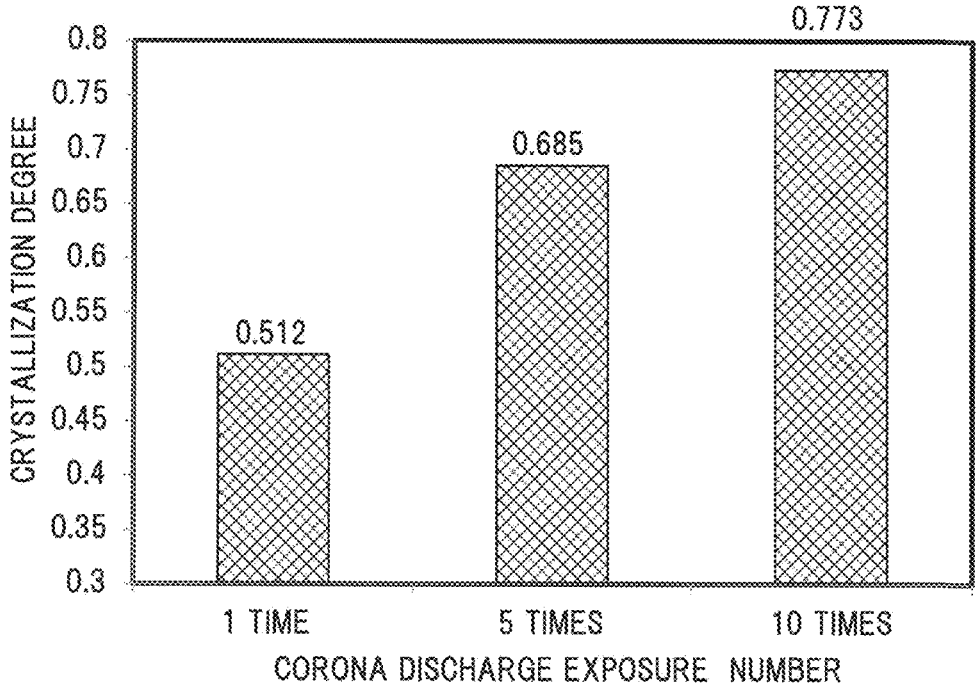
FIGS. 8A and 8B show a relationship between the number of corona discharge exposures and the degree of crystallization, Xc in the electrical insulating body.

FIG. 8A shows a relationship between the number of the corona discharge exposures (the number of scans with the discharge probe) and the degree of crystallization, Xc, in the electrical insulating body 11 subjected to the dry ice blasting treatment with the dry ice blasting pressure being set at 0.50 MPa. FIG. 8A shows that the degree of crystallization, Xc, of the electrical insulating body 11 was increased with the increase in the number of the corona discharge exposures.

Figure 8B:
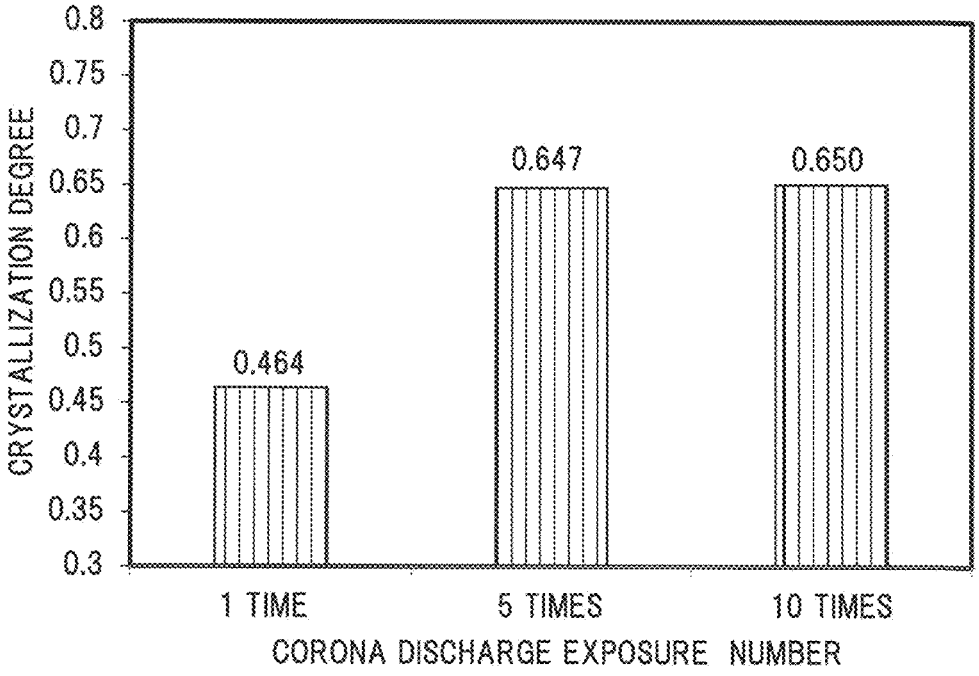

FIG. 8B shows a relationship between the number of the corona discharge exposures and the degree of crystallization, Xc, in the electrical insulating body 11 subjected to the dry ice blasting treatment with the dry ice blasting pressure being set at 0.35 MPa. FIG. 8B shows that the degree of crystallization, Xc, of the electrical insulating body 11 was increased with the increase in the number of the corona discharge exposures.

According to FIGS. 8A and 8B, the tendency of the change in the degree of crystallization, Xc, versus the number of the corona discharge exposures was the same, regardless of the states of the irregularities of the surface of the electrical insulating body 11 resulting from the roughening treatment.

For example, in a case where the dry ice blasting pressure was set at 0.50 MPa, the degree of crystallization, Xc, resulting from the corona discharge exposure being performed 10 times was about 1.5 times the degree of crystallization, Xc, resulting from the corona discharge exposure being performed 1 time. Also, in a case where the dry ice blasting pressure was set at 0.35 MPa, the degree of crystallization, Xc, resulting from the corona discharge exposure being performed 10 times was about 1. 4 times the degree of crystallization, Xc, resulting from the corona discharge exposure being performed 1 time. In this manner, the tendency of the change in the degree of crystallization, Xc, versus the number of the corona discharge exposures was substantially the same in both the cases.

Figure 9A:
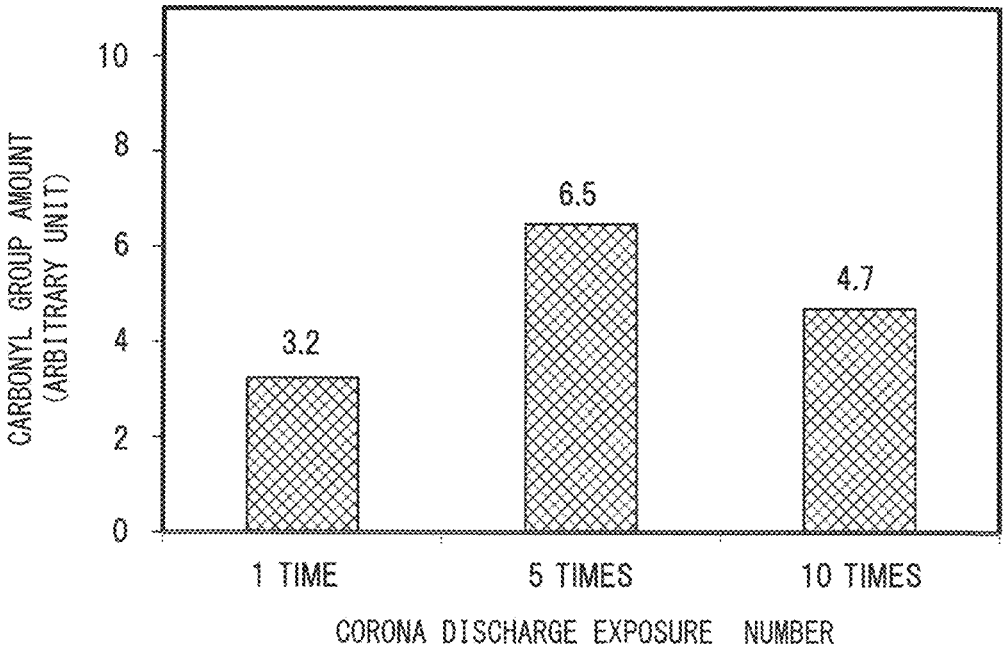
FIGS. 9A and 9B show a relationship between the number of corona discharge exposures and the amount of a carbonyl group produced in the surface of the electrical insulating body.

FIG. 9A shows a relationship between the number of the corona discharge exposures and the amount of the carbonyl group produced in the surface of the electrical insulating body 11, in the electrical insulating body 11 subjected to the dry ice blasting treatment with the dry ice blasting pressure being set at 0.50 MPa. The carbonyl group is a polar functional group, and the more the carbonyl group in the surface of the electrical insulating body 11, the higher the wettability of the surface.

The amount of the carbonyl group in the surface of the electrical insulating body 11 was calculated by the same method as the integral intensity calculation for the fitting curve for the ATR spectrum for calculating the aforementioned absorption peak intensity Ia of the amorphous component and the aforementioned absorption peak intensity Ic of the crystalline component. That is, for the spectrum peak ascribed to the carbonyl group in the vicinity of 1700 $cm^{-1}$ resulting from the CO stretching vibration of a —COOH group or a —CHO group, the integral intensity was calculated by fitting analysis using the Lorentz distribution function, to estimate the amount of the carbonyl group.

According to FIG. 9A, the amount of the carbonyl group resulting from the corona discharge exposure being performed 5 times was about 2 times the amount of the carbonyl group resulting from the corona discharge exposure being performed 1 time. In addition, the amount of the carbonyl group resulting from the corona discharge exposure being performed 10 times was about 1.5 times the amount of the carbonyl group resulting from the corona discharge exposure being performed 1 time. That is, the wettability of the surface of the electrical insulating body 11 was enhanced by the increase in the number of the corona discharge exposures.

Figure 9B:
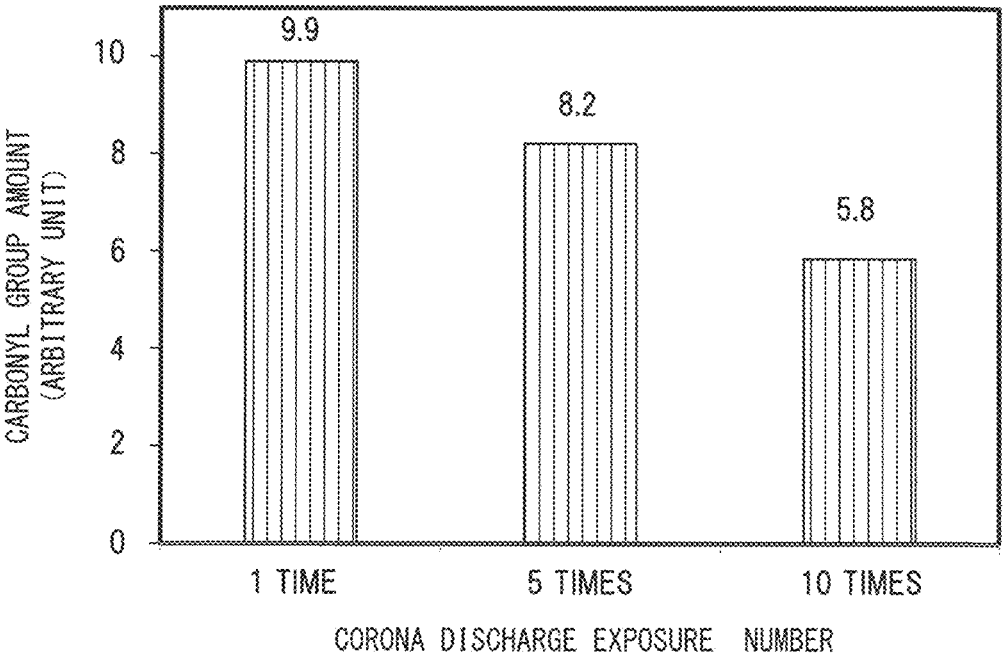

FIG. 9B shows a relationship between the number of the corona discharge exposures and the amount of the carbonyl group produced in the surface of the electrical insulating body 11, in the electrical insulating body 11 subjected to the dry ice blasting treatment with the dry ice blasting pressure being set at 0.35 MPa.

According to FIG. 9B, the amount of the carbonyl group was decreased with the increase in the number of the corona discharge exposures. However, the amount of the carbonyl group produced was larger than when the dry ice blasting treatment was performed with the dry ice blasting pressure being set at 0.50 MPa, and so the enhancement in the wettability of the surface of the electrical insulating body 11 resulting from the corona discharge exposure was able to be confirmed. Note that, in both FIGS. 9A and 9B, the unit of the amount of the carbonyl group was an arbitrary unit, but that since the measurement method therefor and the measurement conditions therefor were the same in both FIGS. 9A and 9B, the ratio of the amount of the carbonyl group in FIG. 9A and the amount of the carbonyl group in FIG. 9B was equal to the actual carbonyl group amount ratio when the dry ice blasting pressure was 0.50 MPa and when the dry ice blasting pressure was 0.35 MPa.

Figure 10:
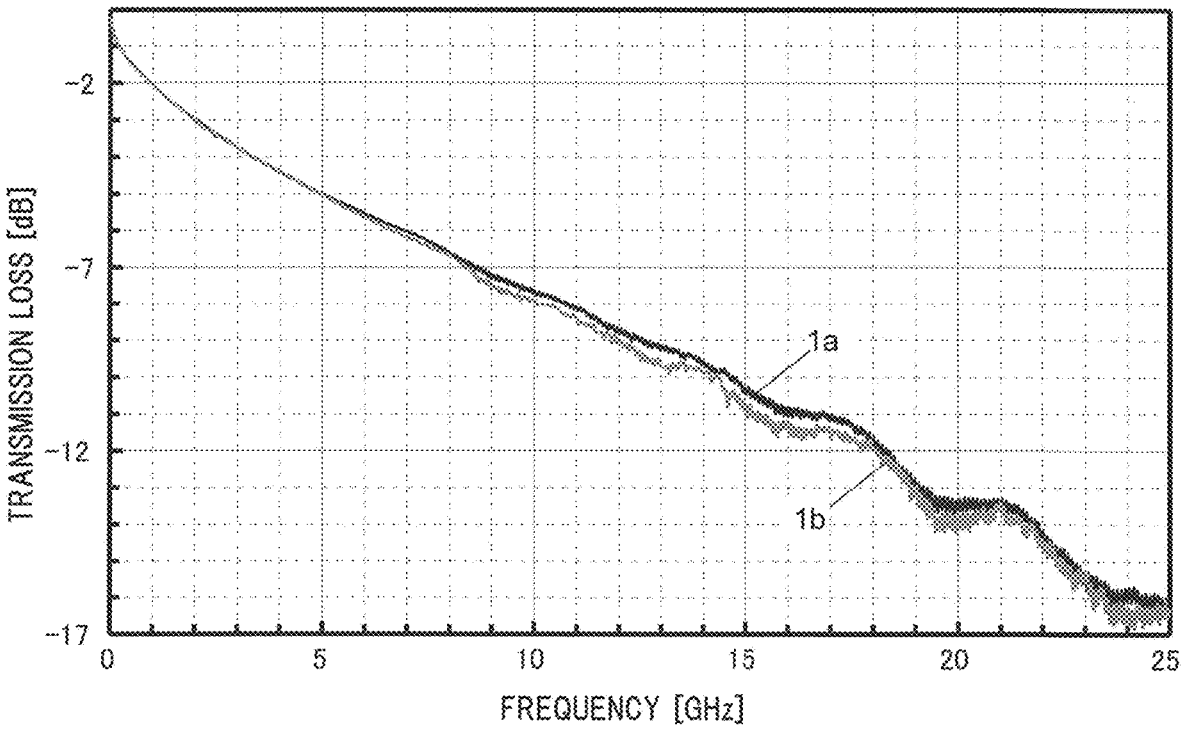
FIG. 10 shows transmission properties of two cables being different in dry ice blasting treatment conditions for the electrical insulating body.

FIG. 10 shows transmission properties of the cable 1 (referred to as cable 1*a*) formed with the shield 12 made of a copper plating layer on the electrical insulating body 11 having a degree of crystallization, Xc, of 0.51 to 0.77 (estimated values based on the data of FIG. 8) subjected to the dry ice blasting treatment with the dry ice blasting pressure being set at 0.50 MPa, and the cable 1 (referred to as cable 1*b*) formed with the shield 12 on the electrical insulating body 11 having a degree of crystallization, Xc, of 0.46 to 0.65 (estimated values based on the data in FIG. 8) subjected to the dry ice blasting treatment with the dry ice blasting pressure being set at 0.35 MPa.

The horizontal axis in FIG. 10 represents the transmission signal frequency, while the vertical axis in FIG. 10 represents the transmission signal loss. FIG. 10 shows that the smaller the value of the transmission loss on the vertical axis (the greater the absolute value of the negative measurement value), the greater the attenuation of the transmission signal, that is, the greater the deterioration resulting from the transmission of the outgoing signal, and the greater the transmission loss. According to FIG. 10, the cable 1*a* and the cable 1*b* were both being lowered in the transmission loss with the increase in the frequency of the transmission signal.

Figure 11A:
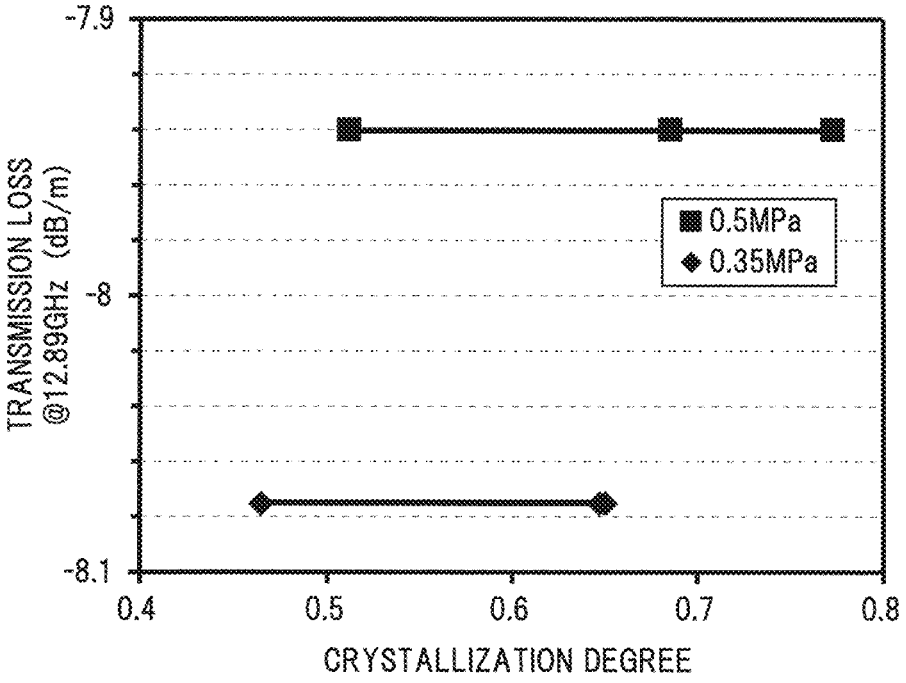
FIG. 11A shows a relationship between the degree of crystallization, Xc, of the electrical insulating body and the transmission loss in two cables being different in dry ice blasting treatment conditions for the electrical insulating body.

FIG. 11A shows a relationship between the degree of crystallization, Xc, and the transmission loss, in the cable 1 having the electrical insulating body 11 subjected to the dry ice blasting treatment with the dry ice blasting pressure being set at 0.50 MPa, and in the cable 1 having the electrical insulating body 11 subjected to the dry ice blasting treatment with the dry ice blasting pressure being set at 0.35 MPa.

The transmission loss in FIG. 11A was the transmission loss when the frequency of the transmission signal was 12.89 GHz. The smaller the value of the transmission loss on the vertical axis (the greater the absolute value of the negative measurement value), the higher the transmission loss.

As shown in FIG. 11A, within the range of the measurement conditions, the dependence of the transmission loss on the degree of crystallization, Xc, was substantially not able to be observed in either of the two types of the cables 1 being different in the dry ice blasting treatment conditions.

Figure 11B:
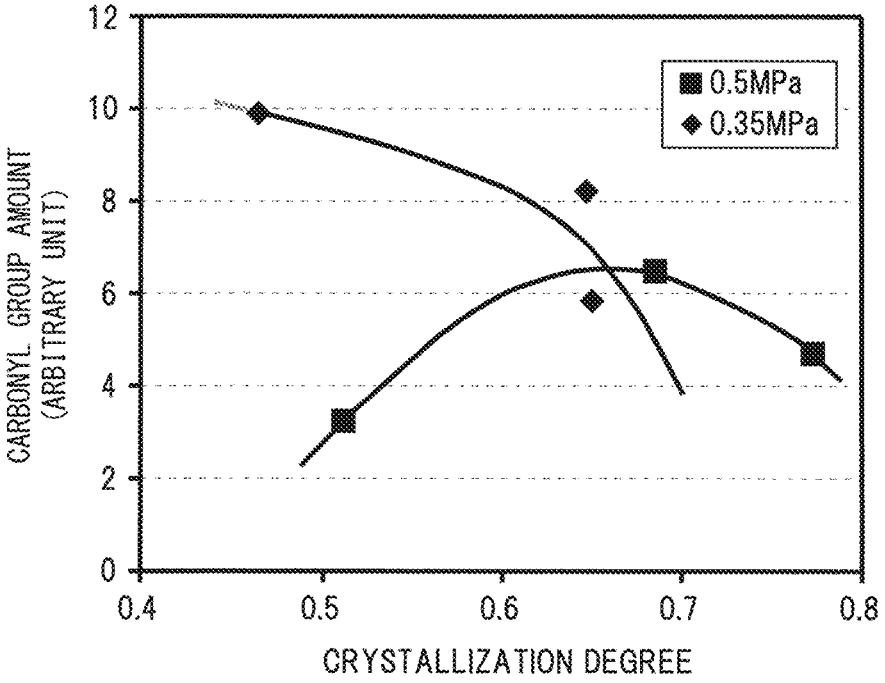
FIG. 11B shows a relationship between the degree of crystallization, Xc, of the electrical insulating body and the amount of the carbonyl group in the surface of the electrical insulating body in two cables being different in dry ice blasting treatment conditions on the electrical insulating body.

FIG. 11B shows a relationship between the degree of crystallization, Xc, and the amount of the carbonyl group in the surface, for the electrical insulating body 11 subjected to the dry ice blasting treatment with the dry ice blasting pressure being set at 0.50 MPa, and for the electrical insulating body 11 subjected to the dry ice blasting treatment with the dry ice blasting pressure being set at 0.35 MPa.

As shown in FIG. 11B, the electrical insulating body 11 subjected to the dry ice blasting treatment with the dry ice blasting pressure being set at 0.50 MPa had the largest amount of the carbonyl group when the degree of crystallization, Xc, was about 0.685, and when the degree of crystallization, Xc, became lower or higher than that value, the amount of the carbonyl group decreased.

On the other hand, in the electrical insulating body 11 subjected to the dry ice blasting treatment with the dry ice blasting pressure set at 0.35 MPa, it was observed that the amount of the carbonyl group had a tendency to decrease when the degree of crystallization, Xc, became higher than about 0.647.

From these results, it was able to be said that when the degree of crystallization, Xc, was within the range of not lower than 0.512 and not higher than 0.685, the amount of the carbonyl group to provide the sufficient wettability was produced, regardless of whether the dry ice blasting pressure was high or low.

(Evaluation of the States of the Surface and the Cross Section of the Cable)

Figure 12A:
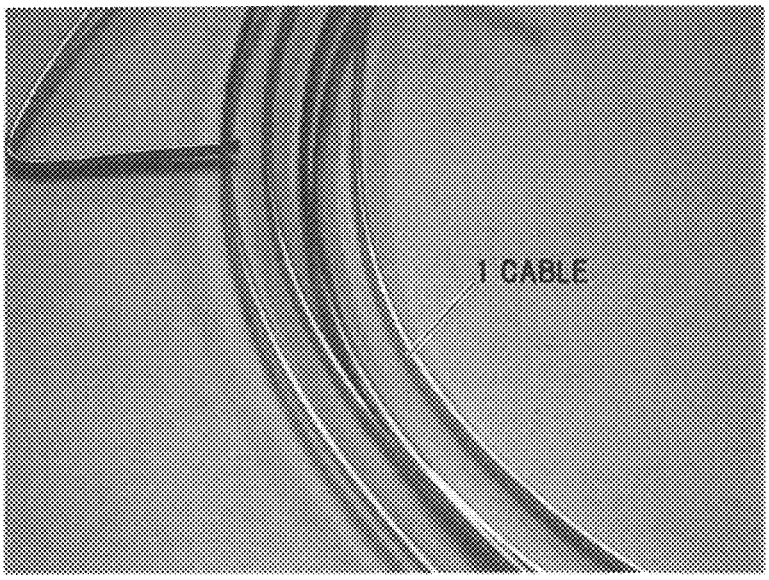
FIGS. 12A and 12B are photographs showing an appearance of the cable according to an example.
Figure 12B:
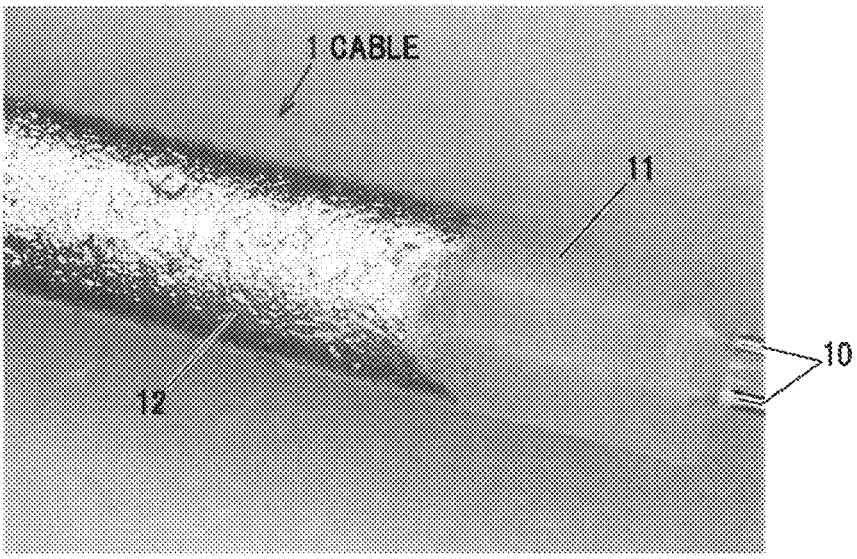

FIGS. 12A and 12B are photographs showing an appearance of the cable 1 having the electrical insulating body 11 having a degree of crystallization, Xc, of 0.65, subjected to the dry ice blasting treatment with the dry ice blasting pressure being set at 0.6 MPa. FIG. 12B is an enlarged photograph showing a tip portion of the cable 1. In FIG. 12B, a streaky pattern extending in the longitudinal direction of the cable 1 was able to be observed on the surface of the shield 12 made of the plating layer. This streaky pattern was created by streaky irregularities formed on the surface of the electrical insulating body 11 when the electrical insulating body 11 was formed by extrusion molding, and this streaky pattern appeared on the surface of the shield 12 because the strength of the adhesion between the electrical insulating body 11 and the shield 12 was high, and the thickness of the shield 12 was uniform.

This showed that the surface treatment of the electrical insulating body 11 allowed the enhancements in the strength of the adhesion between the electrical insulating body 11 and the shield 12, and in the uniformity of the thickness of the shield 12.

Figure 13A:
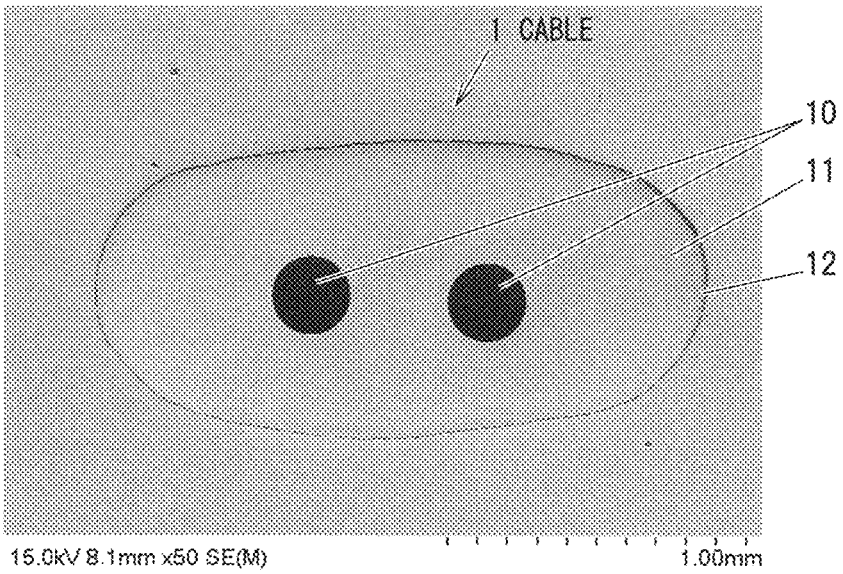
FIGS. 13A and 13B are images observed with a scanning electron microscope showing a transverse cross section of the cable according to this example.
Figure 13B:
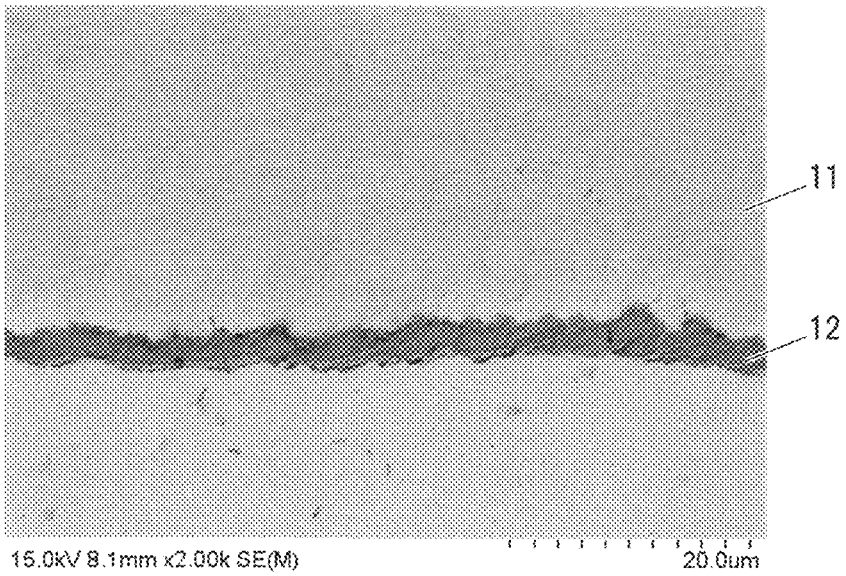

FIGS. 13A and 13B are images observed with a scanning electron microscope (SEM) showing a transverse cross section of the cable 1 as shown in FIGS. 12A and 12B. FIG. 13B is an enlarged observed image showing an interface between the electrical insulating body 11 and the shield 12 of the cable 1. From FIG. 13A and FIG. 13B, it was able to be confirmed that the strength of the adhesion between the electrical insulating body 11 and the shield 12, and the uniformity of the thickness of the shield 12 were high.

SUMMARY OF THE EMBODIMENTS

Next, the technical ideas grasped from the above-described embodiments will be described with the aid of the reference characters and the like in the embodiments. It should be noted, however, that each of the reference characters and the like in the following descriptions is not to be construed as limiting the constituent elements in the claims to the members and the like specifically shown in the embodiments.

[1] A linear shape member (1), comprising: a linear shape electrical insulating body (11) comprising irregularities on a surface (11); and a plating layer (12) coating the surface of the electrical insulating body (11), wherein an average irregularities spacing Sm of the irregularities is not more than 20.0 μm.

[2] The linear shape member (1) according to the above [1], further comprises a linear shape conductor (10), with the electrical insulating body (11) coating a periphery of that linear shape conductor (10), wherein the plating layer (12) acts as a shield.

[3] A method for producing a linear shape member (1), comprising: performing a roughening treatment on a surface of a linear shape electrical insulating body (11); and after the roughening treatment, performing a plating treatment on the surface of the electrical insulating body (11) to form a plating layer (12) thereon, wherein the roughening treatment (11) allows an average irregularities spacing Sm of the irregularities to be reduced to not more than 20.0 μm.

[4] The method for producing the linear shape member (1) according to the above [3], wherein the roughening treatment (11) is performed by a blasting treatment.

[5] A linear shape member (1), comprising: a linear shape electrical insulating body (11); and a plating layer (12) coating a surface of the electrical insulating body (11), wherein, within a region of a depth of up to 1 μm from the surface of the electrical insulating body (11), a degree of crystallization, Xc, represented by equation 1 below is not lower than 0.512 and not higher than 0.685, where Ic in the equation 1 denotes an absorption peak intensity of a crystalline component in a Fourier transform infrared absorption spectrum in the electrical insulating body (11), while Ia in the equation 1 denotes an absorption peak intensity of an amorphous component in the Fourier transform infrared absorption spectrum in the electrical insulating body (11).

[Equation 7]

$$X_c = 1 - \frac{\left(1 - \frac{I_c}{I_a}\right)/1.233}{\left(1 + \frac{I_c}{I_a}\right)}$$

[6] The linear shape member (1) according to the above [5], wherein the electrical insulating body (11) comprises a polyethylene.

[7] The linear shape member (1) according to [5] or [6] above, further comprising: a linear shape conductor (10), with the electrical insulating body (11) coating a periphery of that linear shape conductor (10), wherein the plating layer (12) acts as a shield.

[8] A method for producing a linear shape member (1), comprising: performing a modification treatment on a surface of a linear shape electrical insulating body (11); and after the modification treatment, performing a plating treatment on the surface of the electrical insulating body (11) to form a plating layer (12) thereon, wherein the modification treatment allows a degree of crystallization, Xc, represented by equation 2 below within a region of a depth of up to 1 μm from the surface of the electrical insulating body (11) to be increased to within a range of not lower than 0.512 and not higher than 0.685, where Ic in the equation 2 denotes an absorption peak intensity of a crystalline component in a Fourier transform infrared absorption spectrum in the electrical insulating body (11), while Ia in the equation 2 denotes an absorption peak intensity of an amorphous component in the Fourier transform infrared absorption spectrum in the electrical insulating body (11).

[Equation 8]

$$X_c = 1 - \frac{\left(1 - \frac{I_c}{I_a}\right)/1.233}{\left(1 + \frac{I_c}{I_a}\right)}$$

[9] The method for producing the linear shape member (1) according to the above [8], wherein the electrical insulating body (11) comprises a polyethylene.

[10] The method for producing the linear shape member (1) according to the above [8] or [9], wherein the modification treatment is performed by a corona discharge exposure.

Although the embodiments of the present invention and the examples have been described above, the present invention is not limited to the embodiments and the examples described above, but various modifications can be made without departing from the spirit of the invention.

Further, the embodiments and the examples described above are not to be construed as limiting the inventions according to the claims. In addition, it should be noted that not all the combinations of the features described in the embodiments and the examples are essential to the means for solving the problems of the invention.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A linear shape member, comprising:

a linear shape electrical insulating body comprising irregularities on a surface; and a plating layer coating the surface of the electrical insulating body, wherein an average irregularities spacing Sm of the irregularities is not more than 20.0 μm.

2. The linear shape member according to claim 1, further comprising:

a linear shape conductor, with the electrical insulating body coating a periphery of that linear shape conductor, wherein the plating layer acts as a shield.

3. The linear shape member according to claim 1, wherein a mean spacing of local peaks S of the irregularities is not more than 3.0 μm.

4. The linear shape member according to claim 1, wherein the average irregularities spacing Sm includes an arithmetic mean value of spacings between projections and neighboring depressions in a surface roughness profile on the surface of the liner shape electrical insulating body.

5. The linear shape member according to claim 4, wherein a mean spacing of local peaks S of the irregularities is not more than 3.0 μm, the mean spacing of local peaks S including a mean value of spacings between adjacent local asperity peaks of the projections and the neighboring depressions in the surface roughness profile.

6. The linear shape member according to claim 1, wherein the average irregularities spacing Sm is obtained by sampling a part of a surface roughness profile by a reference length in a direction of a mean line of the surface roughness profile, by calculating, in a sampled part of the surface roughness profile, a sum of lengths of mean line elements of the mean line, each mean line element being in correspondence with one asperity and one valley adjacent to the one asperity, and an arithmetic mean value of spacings between asperities and neighboring valleys in the surface roughness profile.

7. The linear shape member according to claim 1, wherein the linear shape electrical insulating body includes a fluoropolymer resin.

8. A method for producing a linear shape member, the method comprising:

performing a roughening treatment on a surface of a linear shape electrical insulating body; and after the roughening treatment, performing a plating treatment on the surface of the electrical insulating body to form a plating layer thereon, wherein the roughening treatment allows an average irregularities spacing Sm of the irregularities to be reduced to not more than 20.0 μm.

9. The linear shape member producing method according to claim 8, wherein the roughening treatment is performed by a blasting treatment.

10. The linear shape member producing method according to claim 9, wherein the blasting treatment includes a dry ice blasting treatment using dry ice particles as a blasting medium, and wherein, the dry ice blasting treatment is performed under a temperature condition within a range of −80 degrees C. to a room temperature, while particle diameters of the dry ice particles are set in a range of 0.3 mm to 3 mm, and a distance from the surface of the electrical insulating body to a tip of a blasting nozzle for blasting the dry ice particles is set in a range of 0 cm to 10 cm.

11. The linear shape member producing method according to claim 10, wherein the linear shape electrical insulating body comprises a fluoropolymer resin.

12. The linear shape member producing method according to claim 8, wherein a mean spacing of local peaks S of the irregularities is not more than 3.0 μm the mean spacing of local peaks S including a mean value of spacings between adjacent local asperity peaks of the projections and the neighboring depressions in the surface roughness profile.

13. The linear shape member producing method according to claim 8, wherein the roughening treatment is performed by dry ice particles as a blasting medium under a temperature condition within a range of −80 degrees C. to a room temperature with particle diameters of the dry ice particles are set in a range of 0.3 mm to 3 mm.

14. The linear shape member producing method according to claim 8, wherein the average irregularities spacing Sm is obtained by sampling a part of a surface roughness profile by a reference length in a direction of a mean line of the surface roughness profile, by calculating, in a sampled part of the surface roughness profile, a sum of lengths of mean line elements of the mean line, each mean line element being in correspondence with one asperity and one valley adjacent to the one asperity, and an arithmetic mean value of spacings between asperities and neighboring valleys in the surface roughness profile.

15. A linear shape member, comprising:

a linear shape electrical insulating body; and a plating layer coating a surface of the electrical insulating body, wherein, within a region of a depth of up to 1 μm from the surface of the electrical insulating body, a degree of crystallization, Xc, represented by equation 1 below is not lower than 0.512 and not higher than 0.685, where Ic in the equation 1 denotes an absorption peak intensity of a crystalline component in a Fourier transform infrared absorption spectrum in the electrical insulating body, while Ia in the equation 1 denotes an absorption peak intensity of an amorphous component in the Fourier transform infrared absorption spectrum in the electrical insulating body

[Equation 1]

$$X_c = 1 - \frac{\left(1 - \frac{I_c}{I_a}\right)/1.233}{\left(1 + \frac{I_c}{I_a}\right)}.$$

16. The linear shape member according to claim 15, wherein the electrical insulating body comprises a polyethylene.

17. The linear shape member according to claim 15, further comprising:

a linear shape conductor, with the electrical insulating body coating a periphery of the linear shape conductor, wherein the plating layer acts as a shield.

18. A method for producing a linear shape member, the method comprising:

performing a modification treatment on a surface of a linear shape electrical insulating body; and after the modification treatment, performing a plating treatment on the surface of the electrical insulating body to form a plating layer thereon, wherein the modification treatment allows a degree of crystallization, Xc, represented by equation 2 below within a region of a depth of up to 1 μm from the surface of the electrical insulating body to be increased to within a range of not lower than 0.512 and not higher than 0.685, where Ic in the equation 2 denotes an absorption peak intensity of a crystalline component in a Fourier transform infrared absorption spectrum in the electrical insulating body, while Ia in the equation 2 denotes an absorption peak intensity of an amorphous component in the Fourier transform infrared absorption spectrum in the electrical insulating body

[Equation 2]

$$X_c = 1 - \frac{\left(1 - \frac{I_c}{I_a}\right)/1.233}{\left(1 + \frac{I_c}{I_a}\right)}.$$

19. The linear shape member producing method according to claim 18, wherein the electrical insulating body comprises a polyethylene.

20. The linear shape member producing method according to claim 18, wherein the modification treatment is performed by a corona discharge exposure.

* * * * *